US007823347B1

(12) United States Patent
Blinn

(10) Patent No.: US 7,823,347 B1
(45) Date of Patent: Nov. 2, 2010

(54) STRUCTURAL MEMBER AND STRUCTURAL SYSTEMS USING STRUCTURAL MEMBER

(76) Inventor: Lawrence Blinn, 211 Jewett Rd., Upper Nyack, NY (US) 10960

( * ) Notice: Subject to any disclaimer, the term of this patent is extended or adjusted under 35 U.S.C. 154(b) by 1729 days.

(21) Appl. No.: 10/979,042

(22) Filed: Nov. 1, 2004

Related U.S. Application Data

(63) Continuation-in-part of application No. 09/794,474, filed on Feb. 27, 2001, now Pat. No. 6,814,184.

(51) Int. Cl.
*E04G 1/00* (2006.01)

(52) U.S. Cl. ..... 52/244; 52/653.2; 52/651.05; 182/186.7

(58) Field of Classification Search ..... 52/653.2, 52/651.05, 244; 182/186.7
See application file for complete search history.

(56) References Cited

U.S. PATENT DOCUMENTS

| | | | | | |
|---|---|---|---|---|---|
| 1,858,512 | A * | 5/1932 | Langenberg et al. | ..... | 52/834 |
| 2,990,203 | A * | 6/1961 | Grover et al. | ..... | 403/174 |
| 4,054,269 | A * | 10/1977 | Stabler | ..... | 256/48 |
| 4,090,798 | A * | 5/1978 | Barton | ..... | 403/171 |
| 4,122,646 | A * | 10/1978 | Sapp | ..... | 52/651.05 |
| 4,250,679 | A * | 2/1981 | Burg | ..... | 52/655.1 |
| 4,379,649 | A * | 4/1983 | Phillips | ..... | 403/172 |
| 4,432,661 | A * | 2/1984 | Phillips et al. | ..... | 403/172 |
| 4,577,449 | A * | 3/1986 | Celli | ..... | 403/191 |
| 4,677,804 | A * | 7/1987 | Holt | ..... | 52/653.2 |
| 4,745,412 | A * | 5/1988 | Creaser, Jr. | ..... | 343/890 |
| 4,803,819 | A * | 2/1989 | Kelsey | ..... | 52/309.1 |
| 5,240,089 | A * | 8/1993 | Spera | ..... | 182/186.7 |
| 5,390,463 | A * | 2/1995 | Sollner | ..... | 52/650.2 |
| 5,938,364 | A * | 8/1999 | Hayden | ..... | 403/171 |
| 6,205,739 | B1 * | 3/2001 | Newlin | ..... | 52/655.1 |
| 6,321,502 | B1 * | 11/2001 | Castano | ..... | 52/653.2 |
| 7,516,590 | B2 * | 4/2009 | Brinkmann | ..... | 52/651.01 |
| 7,587,862 | B2 * | 9/2009 | Reynolds et al. | ..... | 52/81.3 |
| 2003/0012607 | A1 * | 1/2003 | Coday et al. | ..... | 405/272 |
| 2004/0154236 | A1 * | 8/2004 | Kinzer | ..... | 52/79.1 |

* cited by examiner

*Primary Examiner*—Richard E Chilcot, Jr.
*Assistant Examiner*—Mark R Wendell
(74) *Attorney, Agent, or Firm*—Locke Lord Bissell & Liddell LLP

(57) ABSTRACT

A structural member includes a tubular main body with attached, radially oriented longitudinal flanges. The structural member and accessory components are used to construct a variety of versatile, strong, lightweight, easily assembled, easily disassembled, and easily transportable devices and structures.

12 Claims, 50 Drawing Sheets

STRUCTURAL MEMBER AND STRUCTURAL SYSTEMS USING STRUCTURAL MEMBER

CROSS-REFERENCE TO RELATED APPLICATION(S)

This application is a continuation-in-part application of U.S. Ser. No. 09/794,474 filed on Feb. 27, 2001 now U.S. Pat. No. 6,814,184, which is hereby incorporated by reference.

FIELD OF THE INVENTION

This present invention relates to the field of structural and building systems and structural components used in such systems, more particularly to strong, multipurpose, lightweight and easily transportable structural and building systems.

DESCRIPTION OF THE RELATED ART

Various types of structural components and systems have been developed, some for temporary use, and some for permanent installation. While typically strong, a common problem with structural systems and components for permanent installation is they are heavy, difficult to handle and have a relatively high cost. In contrast, with temporary structures transportability may be improved, but with this, overall strength usually suffers. A common problem with both permanent and temporary structures and structural components is that they are usually constructed for, and suitable for only one application—for example as a scaffolding component, flagpole, sign post, and the like, and are not suitable nor easily adaptable to other applications.

SUMMARY OF THE INVENTION

An object of the invention is to address the above-described deficiencies of the related art by providing a structural member and accessory components to create versatile, lightweight, strong, inexpensive, easily assembled and easily transportable structures.

The present invention relates to a structural member and structural systems using the structural member. The structural member, in a preferred embodiment, comprises a tube having external longitudinal, radially projecting flanges that are regularly angularly spaced about the circumference of the tube. The tube may have a cross-section in the shape of a circle, square, hexagon, octagon, or any other regular polygonal shape. Typically, the structural member is extruded from aluminum, but may be manufactured from an any of a variety of materials (including non-metals), and may be fabricated by methods other than by extrusion. In instances where parts of structural systems utilizing the structural member 1 are exposed to damage or exceedingly high loads, stronger materials, such as steel, may be used.

Alone, the structural member benefits from a cross-section that supports very high resistance to applied loads in all dimensions under a variety of loading conditions (compression, tension, shear, torsion, combined loading, etc.) When used in combination with other components, which will be described in more detail below and in the appended drawings, a variety of strong and versatile structures can be created quickly, efficiently and inexpensively.

Structures that may be assembled using the structural member, in combination with other components include scaffolding structures, shoring structures, post-shore jacks, support structures or towers, box girders, platforms (e.g., for a helicopter landing pad), stages (such as for theatre or special events), bailey-type bridge structures, crane support structures, roof structures, trusses, theatrical light bars and other structures. Additionally, the structural member may be used in permanent structures as a primary or accessory structural component.

Due to the relatively high strength, stability and subsequent ability for weight reduction afforded by the shape of the structural member, many applications of the structural member are possible. Also, due primarily to the light weight and "modular" nature of the structural member, the structural systems using the structural member may be implemented in locations not easily accessible by conventional technologies. For example, with the structural member and associated structural systems, the largest and heaviest component is usually the structural member itself. Since the structural members are typically, in size, about 10 feet in length (though they may be longer or shorter), and since they are typically manufactured from aluminum, they may be carried by individual workpeople, without the need for cranes, hoists or other lifting devices. Moreover, since the size of the structural member is relatively manageable, as are the other components of the structural systems, they may be brought into and assembled within confined quarters where bringing in a larger component, a pre-assembled structure or partially assembled components would be impossible.

The benefits to the subject structural member and structural systems should become apparent to those knowledgeable in the art, in light of the below Detailed Description, Claims, and Drawings.

DETAILED DESCRIPTION OF THE DRAWINGS

Figure 1:
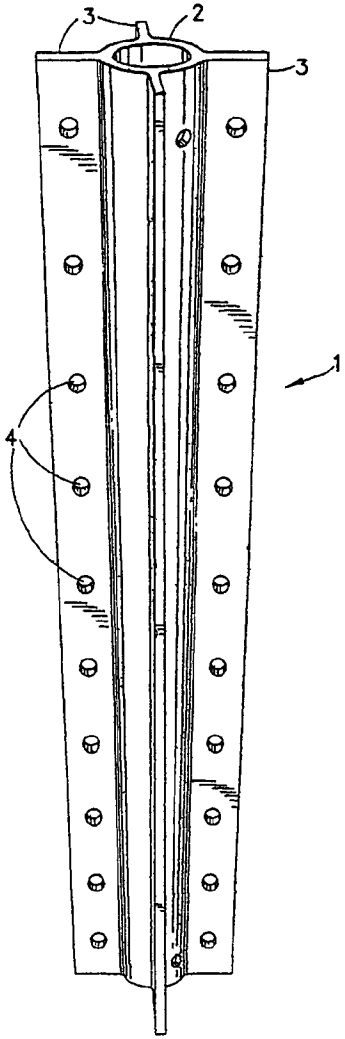
FIG. 1 shows an isometric view of the subject structural member.

A structural member 1 according to one embodiment of the invention is shown in isometric view in FIG. 1. The structural member 1, in a preferred embodiment, comprises an extruded hollow tube 2 with four equally-spaced exterior radially-projecting flanges 3. The flanges have regularly spaced holes 4 for easy attachment of other members 1 at many vertical locations. Such structural members 1 can extend to lengths of over 25 feet each, although lengths of approximately 10 feet are typical. Structural members 1 may be used as the prime vertical and horizontal supports in the structures in which they are used. The structural members 1 are typically arranged such that the flanges 3 extend from the tube 2 of each structural member 1 and are directed toward opposing structural members 1 within the structural system ("interior flanges"), while the other two are directed toward the outside of the structural system ("exterior flanges").

Figure 2:
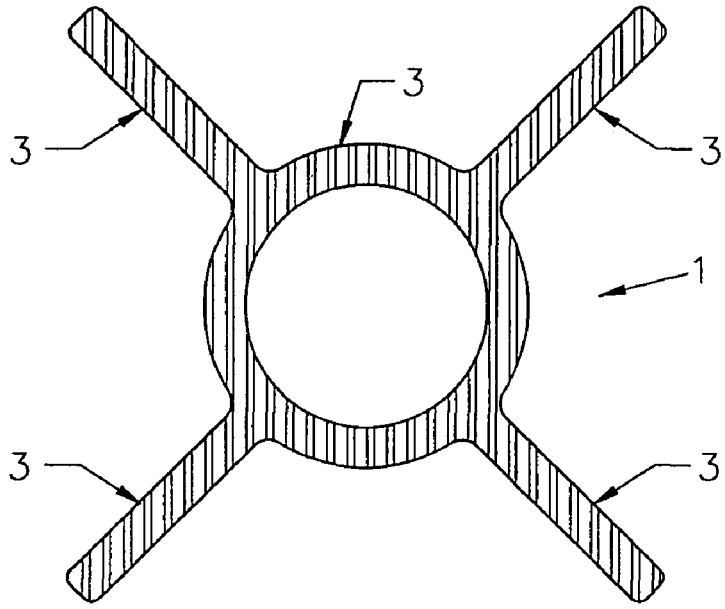
FIG. 2 shows a section view of a structural member.

A cross section of a structural member 1 of one embodiment of the invention is shown in FIG. 2. Structural members 1 can be extruded from a variety of aluminum alloys for strength and light weight. For most applications, inner diameters are between 3 and 6 inches and wall thicknesses are between 0.3 and 0.8 inches. Flanges 3 extend radially from the outer diameter of the tube for lengths between 2 and 4 inches. Of course, the flanges 3 can be manufactured separately and attached to the vertical structural 1 by known means, such as by welding, riveting, or bolting. Although FIG. 2 shows an embodiment with a tube 2 having a circular cross-section, the invention is not limited to structural members of circular cross-section.

By adding radial flanges 3 to the tubular portion 2, the invention provides advantages in several ways. First, the flanges 3 increase the area moment of inertia about the neutral axis, thus reducing the bending and torsional stresses that develop in the structural member 1. Of course, lower stresses translate into enhanced load bearing capability and greater allowable un-braced lengths. Radially-projecting, substantially rectangular flanges 3 are but one embodiment of the invention. Radially-projecting "T" members or other members of various cross sections which increase the area moment of inertia also fall within the scope of the invention.

A second advantage to the structural member design is that it avoids an exceedingly "weak" axis. The distribution of the four radial flanges 3 from the circular cross-section provides equivalent load-bearing capability in each of these four directions, as well as in diagonal directions. Consequently, the structural members 1 do not have to be oriented about their own axes in any particular way to achieve the desired strength. This is in distinction to other common structural member cross sections such as angles, channels and I-beams which require special attention to axial orientation to avoid applying highest loads to weak axes.

A third benefit of the instant structural member design is the plurality of regularly spaced holes 4 in each of the flanges 3. These holes 4 in the flanges 3 that run the length of the structural members 1 provide a ready availability of structural connection points. Structural connections can be made at either interior or exterior flanges 3. The benefit of this feature is enhanced flexibility in accommodating the scaffolding system to the particular requirements of a specific project site. Platforms can be located at elevations corresponding to floor levels, windows or other elements of the building upon which work is to be done.

The invention encompasses various fastening mechanisms for structurally joining the various members (e.g., columns, girts, and braces) used to configure the scaffolding assembly. FIGS. 3A-D illustrate various views of connection adapters 5, 7, 9. These structural connection members 5, 7, 9 are used to structurally join two structural members 1 vertically one above the other. The connection adapters 5, 7, 9 shown in FIG. 3 also allow for girts and braces to be attached at this location. The above and below-described structural components, in combination with girts and braces (collectively "bracing members") are used to construct the structural systems.

Depending on the application, bracing members may have any of a variety of cross-sections. Girts and braces may have a solid rectangular cross-section, though other shapes are possible. With such a rectangular cross-section, standard sizes of flat stock may be used. In other embodiments, the girts and braces may utilize a tubular cross-section (typically square in shape), though bars and tubes having cross-sections of other shapes are also possible. Depending on the application (orientation, loads, etc.) and/or desired aesthetics of the completed structural assembly, the girt and brace shapes may be pre-selected accordingly.

Figure 4A:
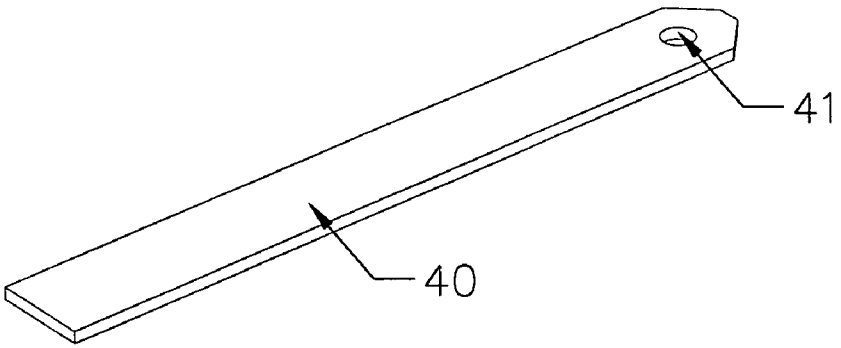
FIGS. 4A-4D illustrate exemplary mounting ends for bracing members used in the subject structural systems.

A basic mounting end 44, 49 for the bracing members, as shown in FIG. 4A, includes a hole 41 in one end of the bracing member 40 to accept a connecting bolt, enabling attachment to other pieces of the structural system. In an alternate embodiment, such a mounting end may involve a second piece attached to the bracing member itself, this piece having a hole therein to allow attachment.

Figure 4D:
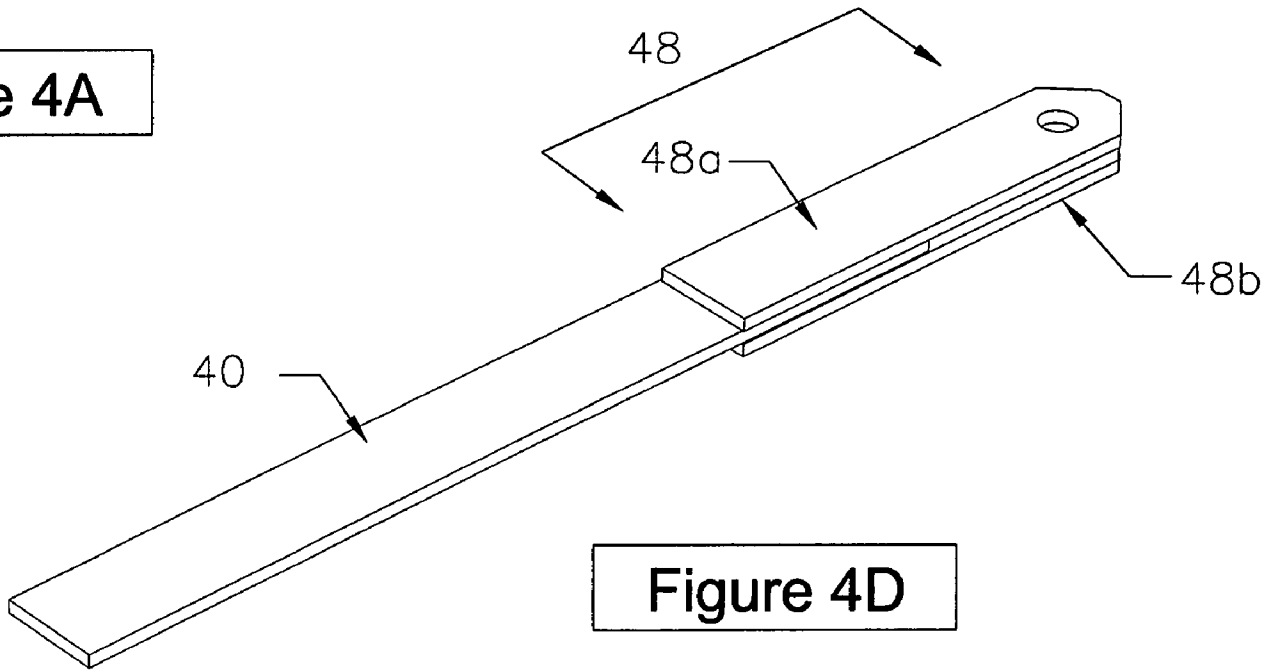

As seen in FIG. 4D, when using a flat bracing member 40, a double shear connection is configured, in one embodiment, by attaching mounting ears 48*a*, 48*b* on each face of the flat bracing member 40. As such, a simple and inexpensive symmetrical attachment end is created.

Figure 4B:
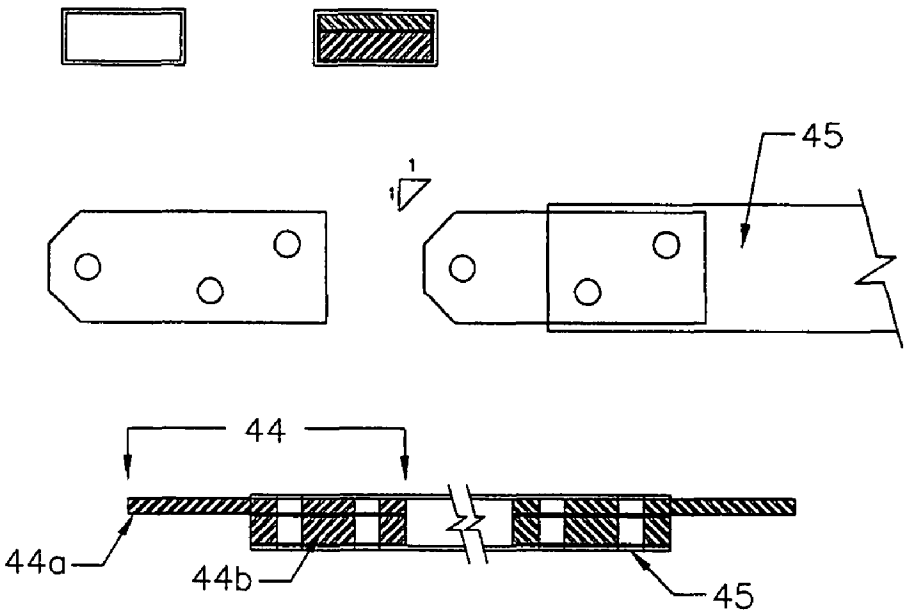

In the case of a tubular bracing member 45 (FIGS. 4B and 4C), one or more plates 44*a*; 44*b*; 49*a*; 49*b* are arranged on one or more ends of the bracing member 45. In some embodiments of the bracing member mounting end 44; 49, the mounting end is pre-assembled and is inserted into an end of the tubular bracing member 45. Such assembly may include only a single solid piece of metal, but preferably may include multiple parts. FIG. 4B illustrates a "single shear" mounting end, in which one component of the mounting end 44 acts as a mounting ear 44*a*, while a second component acts as a spacer 44*b*, to secure the mounting end 44 to the tubular bracing member 45.

Figure 4C:
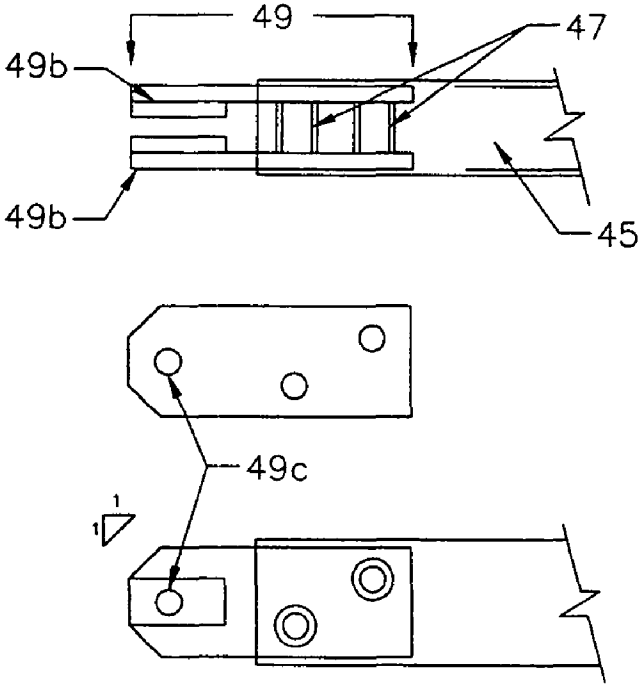
Figure 5:
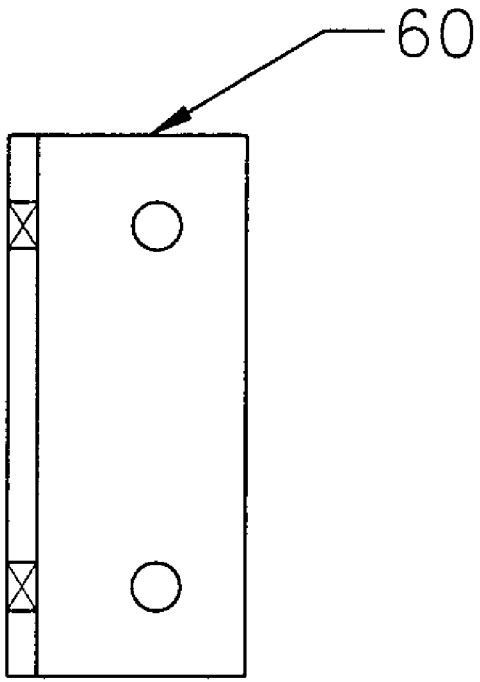
FIG. 5 illustrates a single splice member for joining ends of the subject structural members to one another.

As seen in FIG. 4C, to create a double shear mounting end 49, mounting ears 49*a*; 49*b* are assembled to sit against opposite interior walls of the tubular bracing member 45. Prior to assembly with the bracing member 45, cylindrical spacers 47, which may be manufactured from segments of standard pipe, are inserted between and attached to mounting ears 49*a*; 49*b*, typically by welding. Later, the mounting end 49 may be secured into place within the tubular bracing member 45. Again, the attachment may be accomplished by welding or alternatively, bolts may be used, the bolts passing through the cylindrical spacers 47, or elsewhere if practical.

In certain situations, it is necessary to have a more secure connection than in others. As seen in FIG. 4C, one way of achieving an increased level of rigidity and security for the subject structural systems is to equip each end of the bracing members 45 with a "double shear" connection end 49. With such an end, two matching ears 49*a*; 49*b* are attached to each end of the bracing member 45, and extend away from the bracing member 45, parallel thereto. Each ear 49*a*; 49*b* that extends from the bracing member 45 includes at least one hole 49*c* for attachment to other structural components, such as the flange of a structural member 1. When the double-shear equipped bracing member 45 (in FIG. 4C) is attached to a structural member 1, only a pin need be inserted through the joint to fully restrict relative linear movement. In comparison, with a "single shear" connection, as shown in FIG. 4B, where a bolt would be necessary to fully restrict relative linear movement between components. By adding a second hole in the connection end 49, corresponding to a second hole in another structural component, such as the structural member 1, relative rotational movement between the assembled components can additionally be prevented. With the double-shear connection, assembly times are reduced since time is not required for fastening a nut to a bolt. Instead of a nut, only a cotter pin or the like is necessary for preventing the pin from falling out, thereby decreasing assembly time and associated costs. As still another alternative, a self-locking pin can be utilized. Such pins have retractable projections that prevent accidental removal.

Figure 3A:
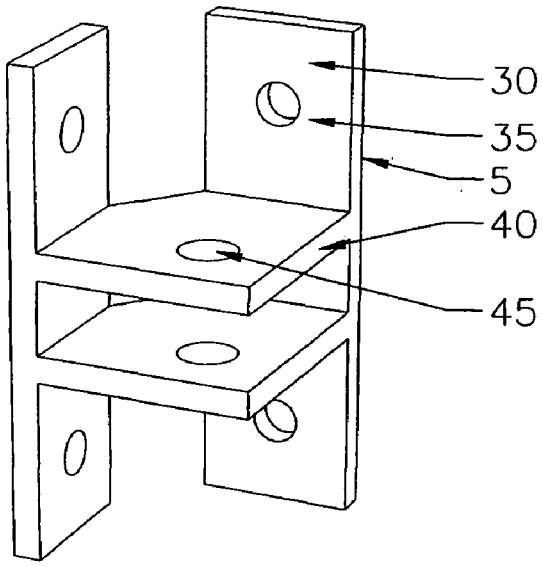
FIGS. 3A-3F illustrate exemplary connection adapters for the subject structural member.
Figure 3B:
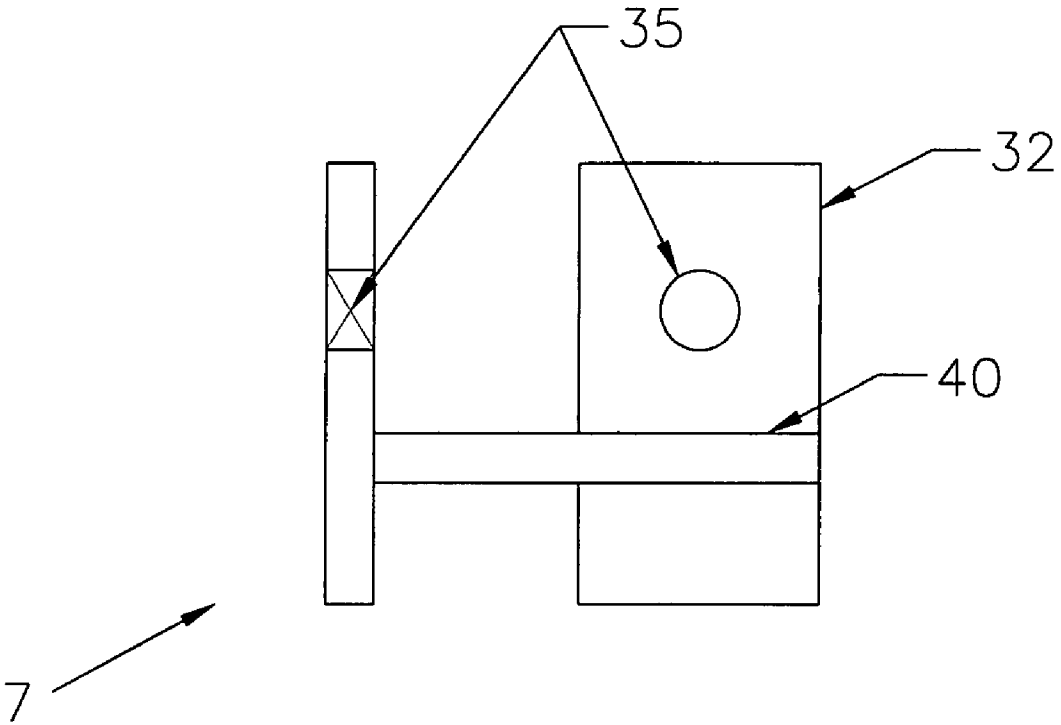
Figure 3D:
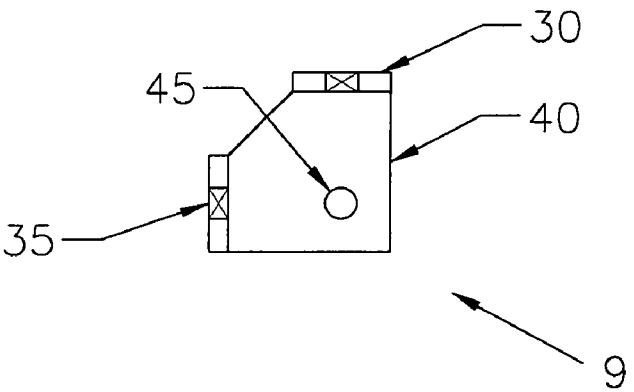
Figure 3C:
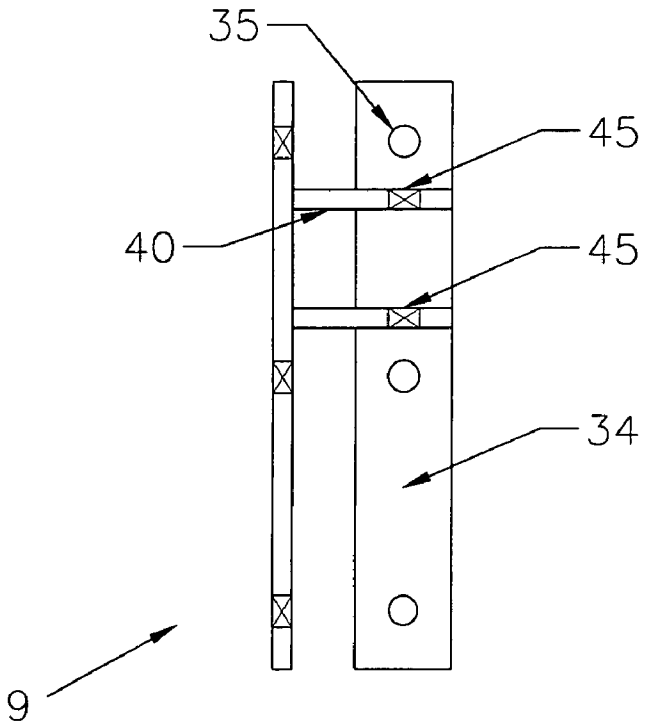
Figure 3E:
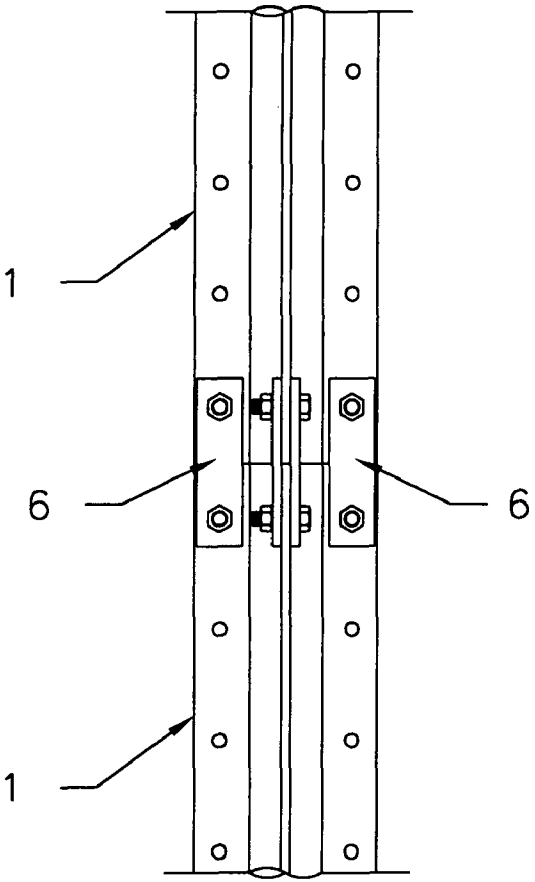
Figure 3F:
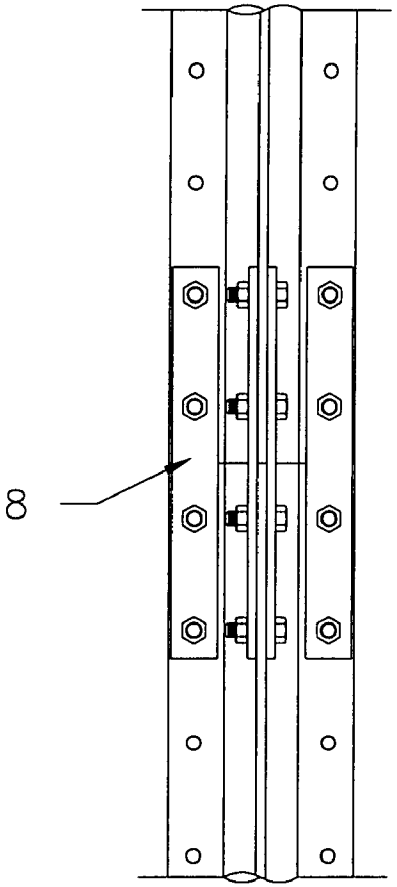

FIGS. 3A-3F, and FIGS. 6A-6C, 7, 8A and 8B illustrate, respectively, nine examples of connection adapters 5-9, 60, 62, 70, and 80 for the subject structural systems. The connection adapters shown in FIGS. 3*e* and 3*f* consist of a pair of flat, elongate plates, the plates being secured by bolts to the flange of the structural member 1, preferably one on each side of the flange. In this case, as with many connection adapters described herein, they are effectively used in sets, for example FIGS. 3*e* and 3*f* illustrate use on all four flanges at the joints between structural members 1. As can be seen, the difference between the connection adapters 6 and 8 is that one version is longer than the other, which advantageously results in a connection with increased stability. The remainder of the connection adapters (FIGS. 3*a*-*d*) include at least one vertical plate 30, 32, 34 and one or more horizontal plates 40. The vertical plate 30, 32, 34 includes holes 35 for bolting to the structural member 1. Holes 45 are provided in the horizontal plates 40 for attachment to external bracing members, supports, ties to external structures, such as adjacent buildings, and the like. The connection adapters 5, 9, illustrated in FIGS. 3*a* and 3*c*, provide a "double-shear connection" by way of a pair of horizontal plates 40. As such, only a pin need be inserted to restrict linear movement between the connection adapters 5, 9, attached structural system and any additional component or structure. FIG. 3*d* illustrates a top view of the connection adapter 9, but is also an exemplary top view of the other aforementioned embodiments of the connection adapters 5, 7.

To provide further versatility and connection strength, connection adapters acting as splice elements for connecting structural members directly together at their ends or along their edges will now be described. Such elements are shown in FIGS. 5, 6A, 6B, 7, 8A-8D and 11. The splice elements may be in the form of single 60, 70, double 80, triple 85, quadruple 87 splice elements, et cetera. The single splice element 60 has a generally U-shaped cross-section but may be two plates 70 bolted together. The double splice element 80 has a generally H-shaped cross-section. Any of these splice elements may be manufactured by extrusion or another suitable method. All splice elements include fastening holes for pinning or bolting to structural members 1.

The single splice member 60, 70 is typically used for connecting structural members 1 end-to-end, in order to span distances greater than the length of a single structural member 1. The double splice member 80, as will be described in more detail below, has various applications in creating very strong, versatile structures.

Figure 8A:
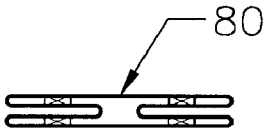
FIGS. 8A-8D illustrate an exemplary splice members for connecting the subject structural members to one another.
Figure 8B:
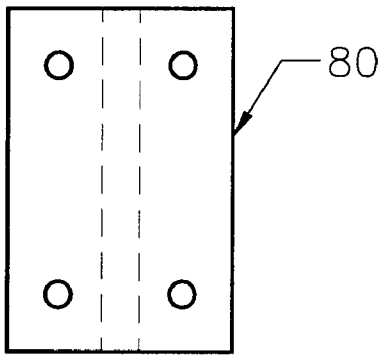
Figure 8C:
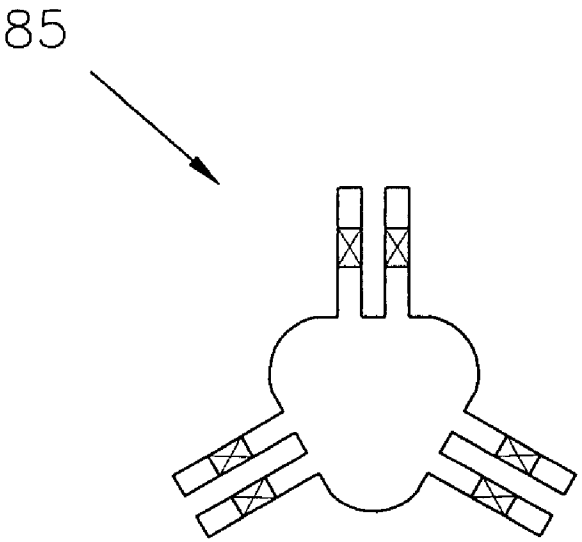
Figure 8D:
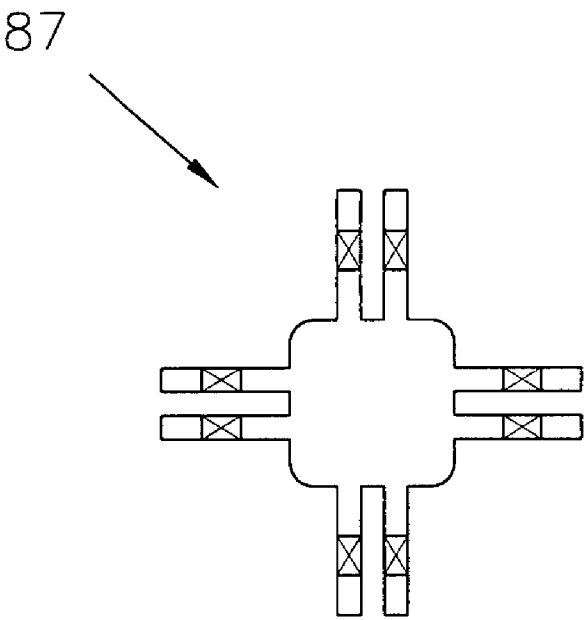

Triple and quadruple splice members 85, 87, as shown in FIGS. 8*c* and 8*d* can be manufactured in a similar manner to the double splice member, each having a common central core with channels for each structural member.

In use, the multiple splice members (for attaching two or more structural members) can connect structural members along adjacent edges to form wall-like structures to act as retaining walls or supporting structures, or can be used to create tower, column, beam, truss or bridge structures (described in further detail below). The splice members are typically shorter in length than the structural members 1, but alternatively may be any length, equal to or greater in length than the structural member 1 itself, depending on the embodiment.

Figure 6A:
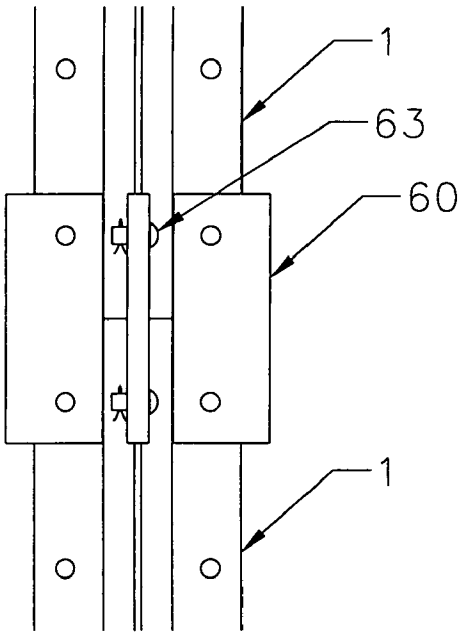
FIGS. 6A-6B illustrate the single splice member and a splice pin for the subject structural systems.
Figure 6B:
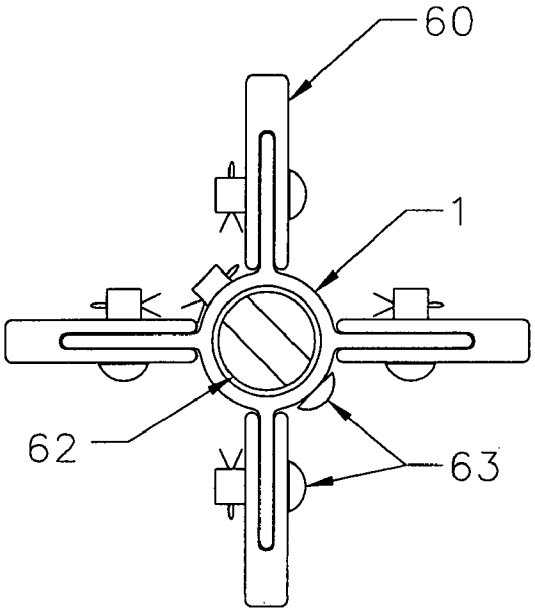
Figure 6C:
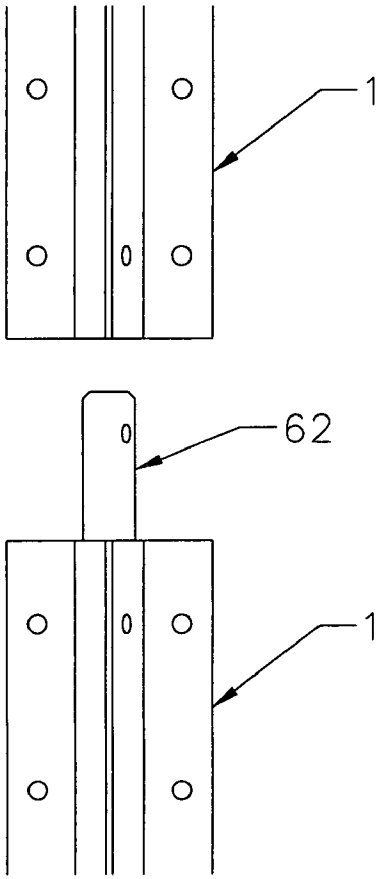
FIG. 6C illustrates the use of a central guiding pin for aligning and/or joining the subject structural members to one another.
Figure 7:
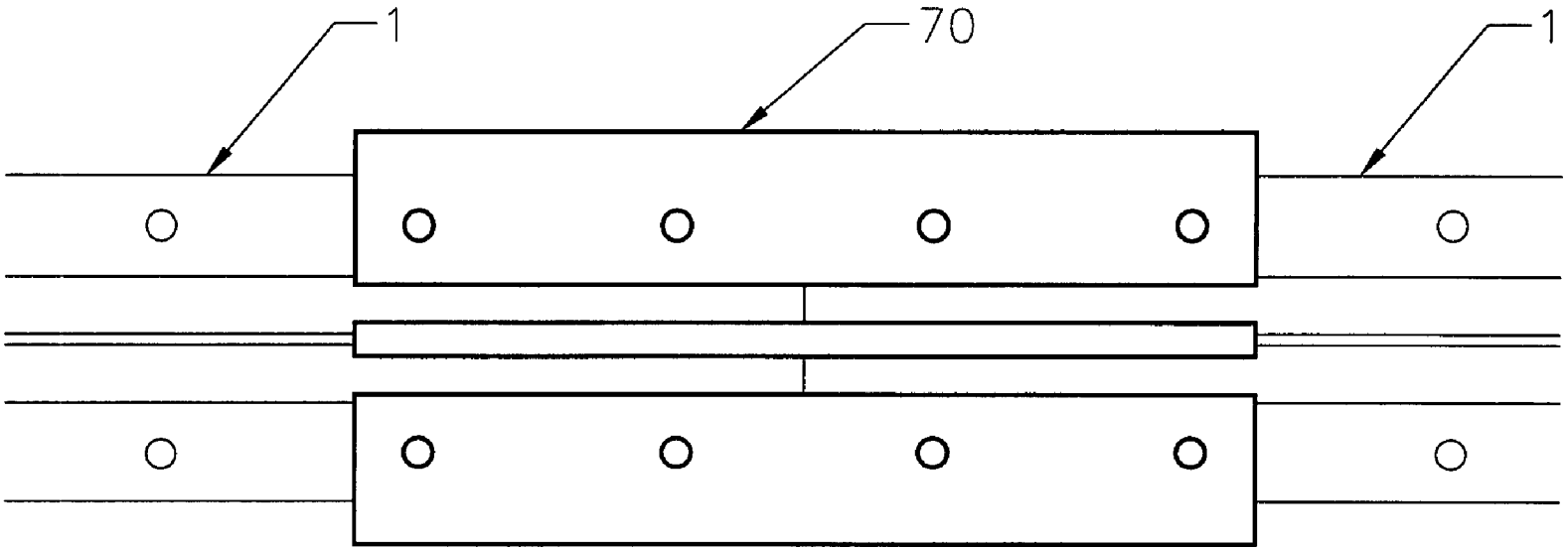
FIG. 7 illustrates splice plates for joining ends of the subject structural members to one another.

Also shown in FIG. 6C is a splice pin 62 for use in connecting the structural members 1 end-to end, and/or to aid alignment of the structural members 1, when joining them. As seen in FIG. 6B, it is possible to pin the splice pin 62 in location with a cotter pin 63. The cotter pin 63 will hold the splice pin 62 in place, and in combination with the splice pin 62, further increase the strength of a union between structural members 1.

Figure 9A:
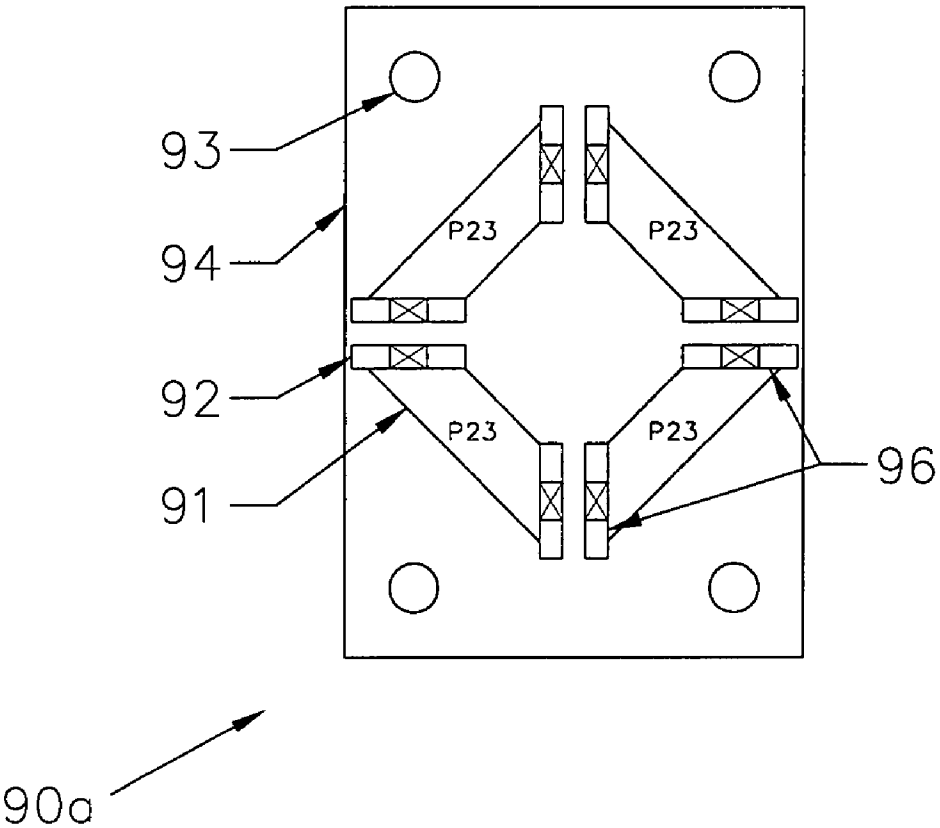
FIGS. 9A-9B illustrate example end caps for the subject structural systems.

FIG. 9*a* illustrates an end cap 90*a* for attachment to an end of the structural member 1. The end cap 90*a* includes a flange 94 to allow attachment to another component, external structure or accessory, such as a wood beam, floor, roof structure or the like by way of holes 93 in the flange 94. The end cap 90*a* also includes mounting portions 92, which are configured to be perpendicular to the flange 94. Typically, a perpendicular arrangement between the components is desirable, however for special purposes they may be assembled at a predetermined angle, other than a right angle, to the flange 94. The end cap 90*a* attaches to the structural member 1 by way of bolts or pins passing through holes 95 in the mounting portions 92. Additionally, the mounting portions 92 are stabilized by braces 91 attached therebetween. Such braces may be welded to or formed integrally with adjacent mounting portions 92. If formed integrally, a single strip of metal is bent at positions corresponding to joints 96. The two ends are then welded to the flange 94 with the connecting middle portion acting as a brace 91.

When used on relatively flat pavement or flat compacted soil, an end cap 90*a* may function as a foot for the subject structural systems. The end cap 90*a*, used as a foot, distributes the loads from the scaffolding systems to the ground, preventing damage to the ground and to the structural member 1 and system itself. The end cap 90*a* distributes the loads evenly between the structural member 1 and structural systems and the ground, but also allows rigid attachment between the structural member 1 and the ground, wood pads, beams, or the like. The end cap 90*a* may also be configured to include an attached protective component, such as a rubber pad, to prevent damage to any underlying surface, or alternatively, the end cap 90*a* may include a textured surface to prevent slippage.

Figure 10:
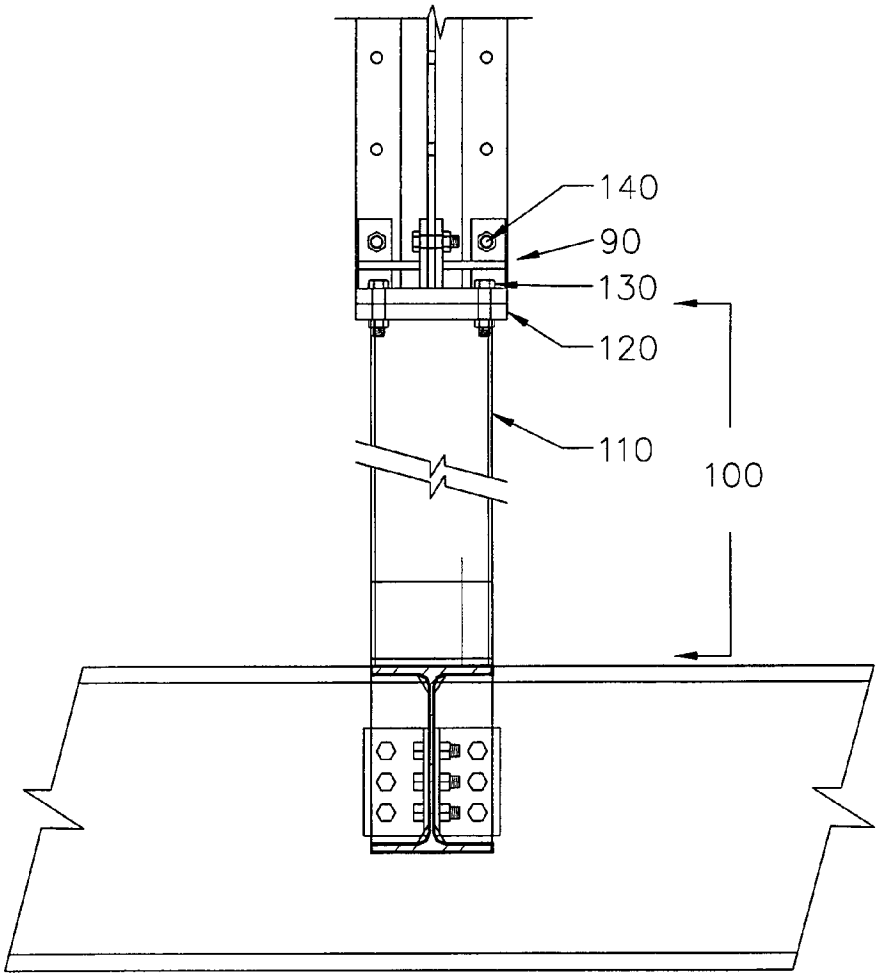
FIG. 10 illustrates an exemplary use of the end cap for the subject structural systems.

FIG. 10 illustrates the end cap 90*a* used as a junction between the subject structural member 1 and a more traditional structure. Holes 93 enable attachment to a supporting structure 100, comprising, in this embodiment, a steel tube 110 having an attached plate 120 at an end nearest the end cap 90*a*. The end cap 90*a* is bolted to the plate 120 of the supporting structure 100 using bolts 130. In-turn, the structural member 1 is attached to the end cap 90*a* via bolts 140.

Figure 9D:
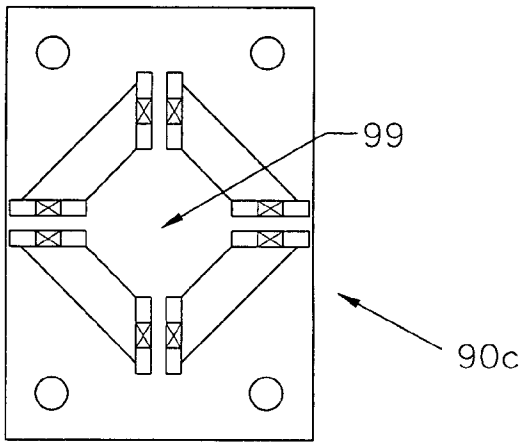
FIGS. 9C-9F illustrate example attachment plates for the subject structural systems.
Figure 9B:
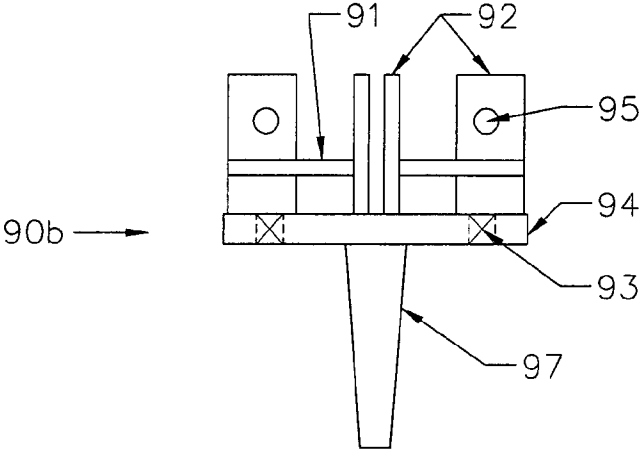

When used on uneven ground, or relatively soft ground (not pavement), a spiked end cap 90*b*, as shown in FIG. 9B may be used. Such a spiked end cap 90*b* may include a single large spike 97, multiple smaller spikes, or a combination thereof. The spiked end cap 90*b* facilitates construction of the subject structural systems in areas in which fitting a regular flat foot would be difficult, destructive or unstable. For example, the spiked end cap 90*b* may be used to assemble a structure on a grassy hill. With prior systems, it would be necessary to remove soil to level an area in which to place a pad to assemble a structure. Instead, if equipped with a single spike 97, the spiked end cap 90*b* merely requires being driven into the ground. When removed, all that is left is a small hole which can easily be filled, or left to settle on its own.

Figure 9C:
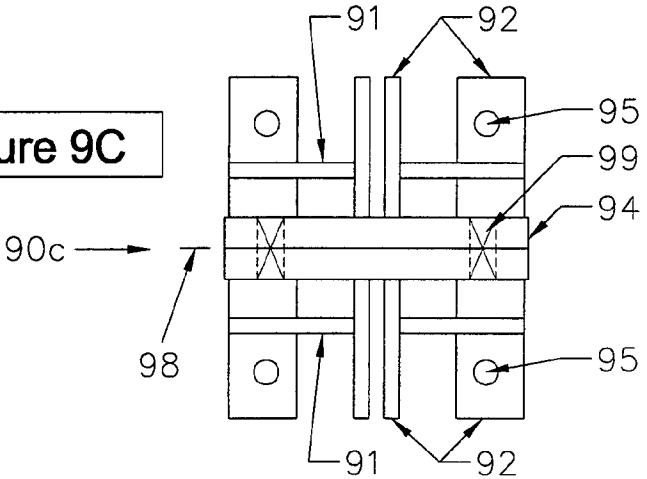
Figure 9E:
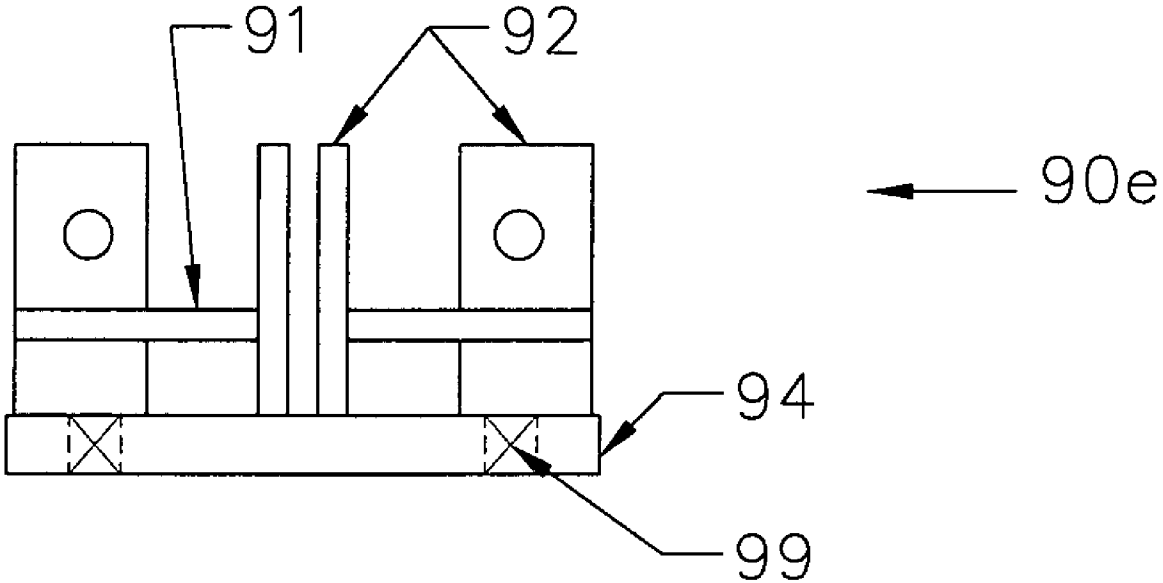

A variation of the end caps 90*a*; 90*b*, are attachment plates 90*c* and 90*e* illustrated in FIGS. 9C-9E. The attachment plates 90*c*, 90*e* provide secure options for attaching platforms, support elements, bracing elements, machinery or other objects to the structural member 1. The attachment plate mounts to the structural member 1 in a similar fashion to the manner in which the end caps 90 mount to the structural member 1. However, the attachment plates 90*c*, 90*e* include an additional central aperture 99 through which the structural member 1 can pass.

The attachment plate 90*c* is symmetric about line 98. As an alternative to the attachment plate 90*c* shown in FIG. 9*c*, an attachment plate 90*e* (FIG. 9E) may include only half of the plate. That is, a variation of the attachment plate comprises the portion of the plate 90*c* that is above (or below) the line 98, and not the other half of the plate. This is useful in situations where reduced strength compared with the "double" attachment plate in FIG. 9C is adequate, and material costs are a concern. The attachment plate 90*c* may also be configured to act as an adapter between different sizes of structural members 1. That is, in a structure utilizing the structural member 1, if two structural members 1 are arranged adjacently in line (vertically or horizontally), and they have two different diameters, they can be joined by the attachment plate 90*c*, having two sides, each sized according to the size of the structural member 1 attached thereto. Alternatively still, if so-desired and to provide additional flexibility, the "double" attachment plate 90*c* can be approximated by bolting two "single" attachment plates 90*e* together, each matched in size with the structural member 1 to which it is to be attached.

Figure 9F:
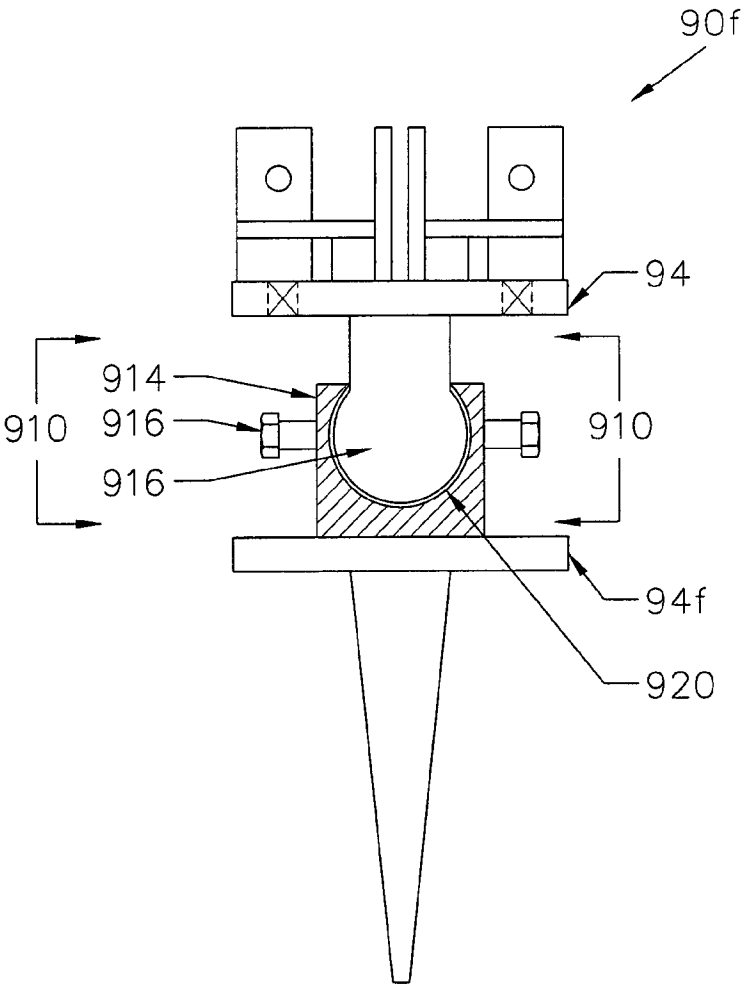

A further variation of the end cap 90*a* and spiked end cap 90*b* is pivotable end cap 90*f*, which may include spikes on its bottom if desired. Pivotable end cap 90*f* includes adjustable components that allow correction of irregularities in underlying pavement or slight errors during insertion of the spiked end cap into soil. While different arrangements for adjustability of the pivotable end cap 90*f* are possible, the embodiment illustrated in FIG. 9*f* shows a ball-in-socket joint 910 arranged between the flange 94 and lower flange 94*f*. The ball-in-socket joint includes a ball 912 affixed to the flange 94, while the lower flange 94*f* includes an attached cylindrical socket 914. The ball 912 is rotatable within the socket 914, until set screws 916 are tightened to prevent the ball from rotating.

Naturally, the relative positions of the ball 912 and socket 914 may be switched such that the socket is above the ball. Additionally, a bearing 920 may be inserted in the socket to distribute the load more evenly. Such a bearing 920 may be made from a dense, durable material, such as high-density polyethylene.

Figure 12A:
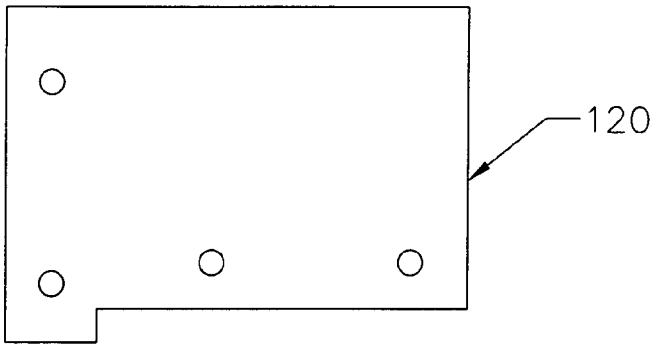
FIGS. 12A and 12B illustrate two embodiments of gusset plates for use in the subject structural systems.
Figure 12B:
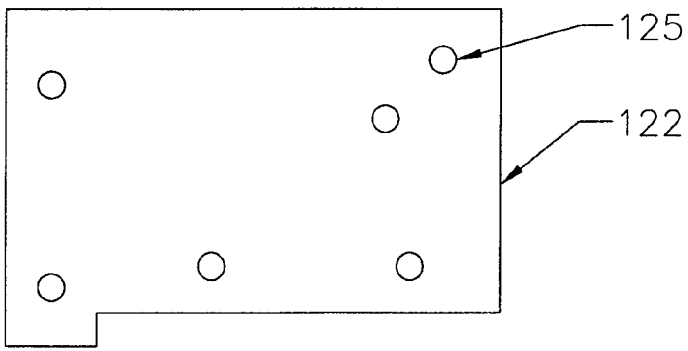
Figure 13A:
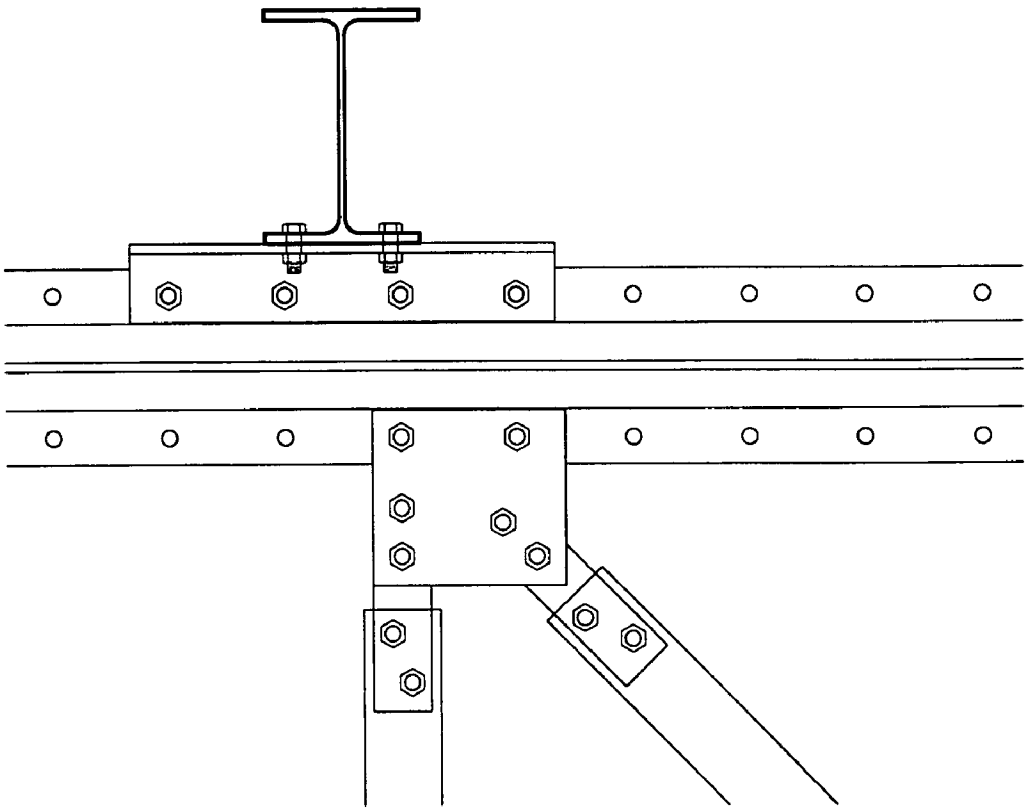
FIGS. 13A and 13B illustrate example connections in the subject structural systems.
Figure 13B:
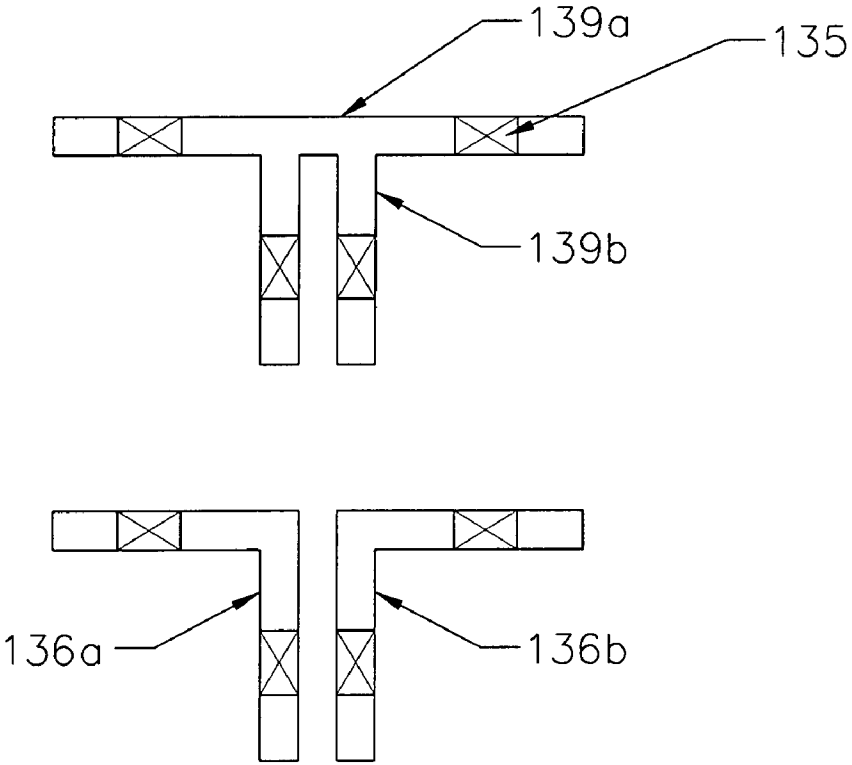

FIGS. 12*a* and 12*b* illustrate example gusset plates 120, 122 for use in rigidifying connections between the structural member 1, bracing members, and/or other structural components. FIG. 13 illustrates but one embodiment in which the tubular bracing members 45 attach to the gusset plate 130, which in-turn attaches to the structural member 1. Bolting via bolts 139 is usual, though welding or pinning, depending on the application, is also conceived. FIGS. 13A and 13B additionally illustrate the manner in which a traditional I-beam 137 or other flat metal components may be integrated into the subject structural systems, and attached to the structural member 1. A single or a pair of angle iron 136*a*; 136*b* may be attached between the structural member 1 and the I-beam 137. Alternatively, a single-piece adapter 135 may be used. This single piece adapter 135 simplifies assembly by providing both a "double shear" connection to the structural member, and by eliminating the need for a work person to maneuver an additional structural component. The single piece adapter also experiences reduced bending stresses, since the upper flange 139*a* is secured by two lower mounting portions 139*b* that stably mount the adapter 135 to the structural member 1.

Figure 14:
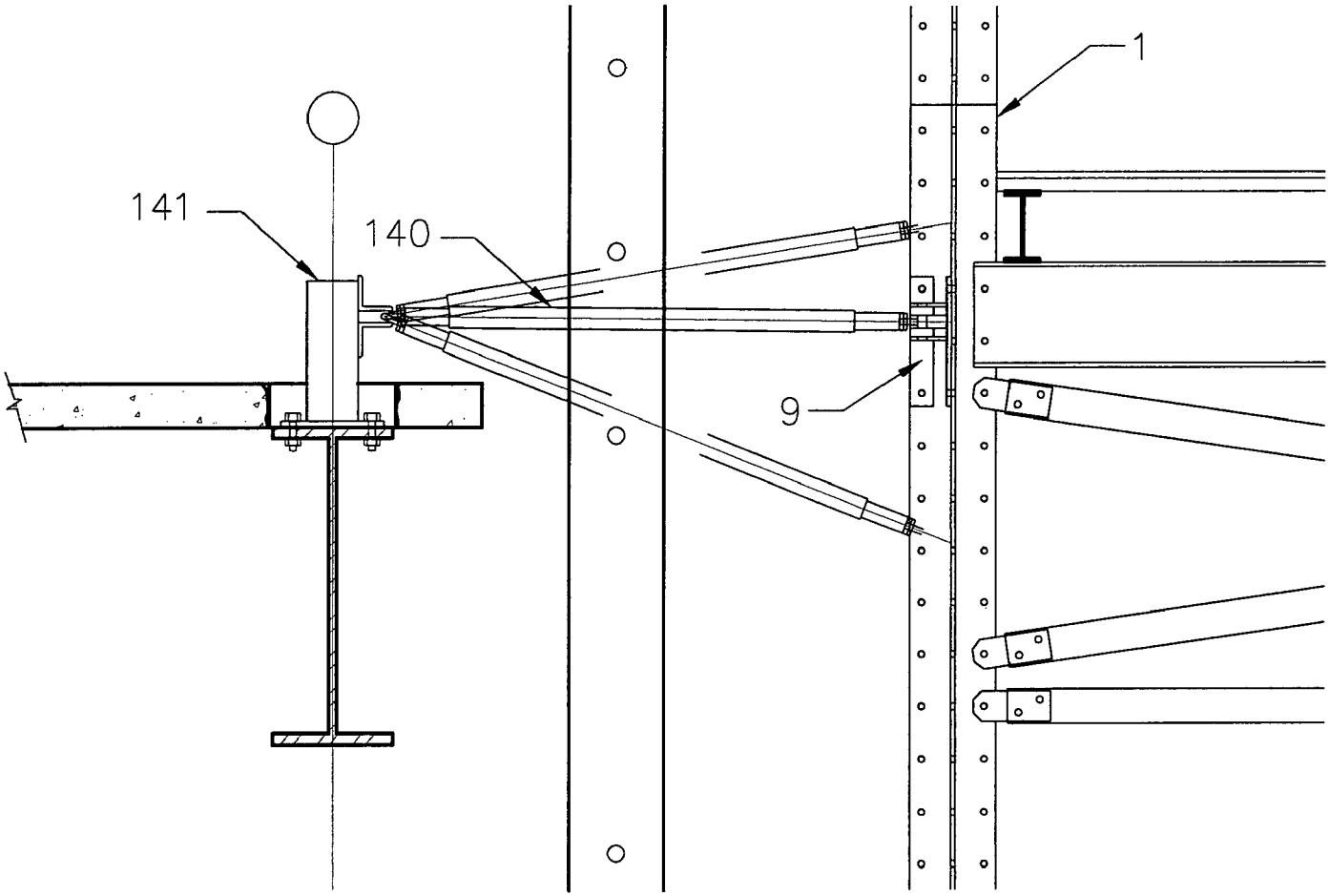
FIG. 14 illustrates a tie arm used in conjunction with one embodiment of the subject structural systems.

FIG. 14 illustrates an adjustable tie arm 140 between a building structure and a scaffolding structure using the subject structural member 1. In this embodiment, the tie arm is attached to a davit post 141 installed in an existing structure. The other end of the tie arm 140 is attached to the structural member 1 by means of a connection adapter 9, which is bolted to the structural member 1.

The structural member 1 is advantageously used in scaffolding systems. Such scaffolding systems may be on the order of a few stories, upward of 100 stories or more. Similarly, platform structures of approximately one story can also be constructed. Such platforms may be used as sidewalk shelters for protecting pedestrians from falling debris, and/or as temporary work platforms outside or inside of buildings.

Some examples of scaffolding structures using the subject structural member are described in U.S. patent application Ser. No. 09/794,474, which is incorporated herein by reference.

Figure 15:
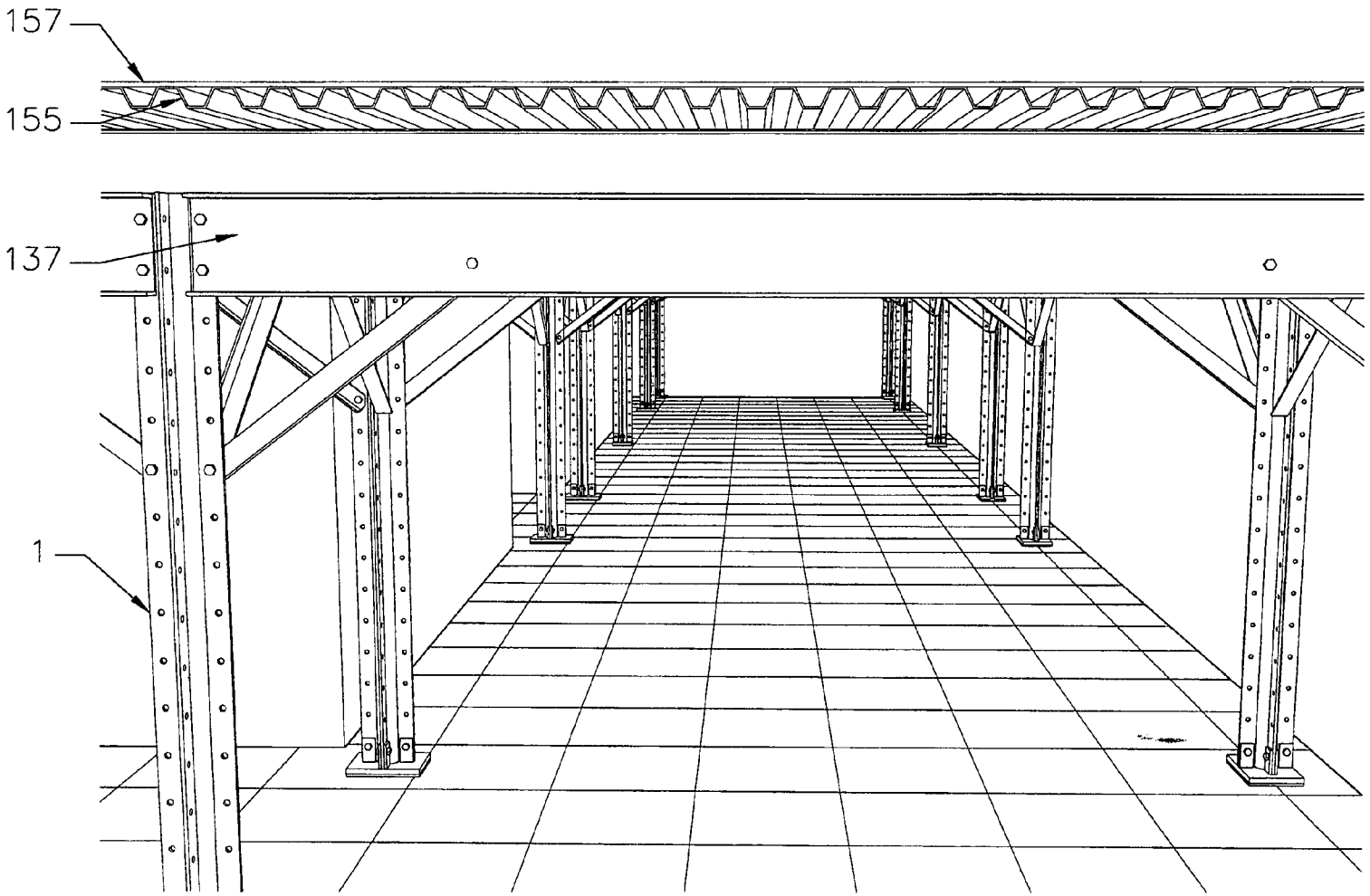
FIG. 15 illustrates one example of a 1-level pedestrian shelter/work platform using the subject structural member.

As a sidewalk shelter or one-level work platform, as seen in FIG. 15, the structural member 1 may be used as a column member, and I-beams 137 may be used as horizontal beams. Alternatively, the structural member 1 itself may be used as a horizontal beam member, provided the appropriate connection components are supplied. End caps 90 are used as feet for the scaffolding structure, and in this embodiment, corrugated steel sheeting 155 is used to span between beams 137, and is topped off with a layer of plywood 157 to create a usable walking surface.

As a further alternative to the use of I-beams as horizontal beam members, the end cap 90 is arranged at the upper end of the structural member 1. Being provided with holes 93, the end cap, and thus the structural member can be attached to virtually any type of roofing or platform material. Typically, wood beams could be used, or metal I-beams could alternatively be mounted to the structural member 1 via the end cap 90.

If bracing is provided directly between adjacent vertically-oriented structural members 1, and thus does not rely upon the rigidity of the roof structure, then the roof itself need not have substantial lateral rigidity. Accordingly, if only protection from weather is desired (and not from falling debris of a construction site), then an inexpensive roll material such as a vinyl, plastic, treated canvas, or the like may be used and supported by the column members to protect pedestrians (or stored objects, such as construction materials) from weather.

As should be realized by those skilled in the art, various other permutations of scaffolding structures are possible through use of the above-described elements and/or those commonly available to contractors. Any structure incorporating the subject structural member 1 benefits from its versatility and its high strength-to-weight ratio.

As a shoring means, the subject structural member proves extremely versatile. Since shoring may be required in confined areas or areas in which access is restricted to a small passageway, the maneuverability of the structural member 1 and the individual components of the structural system are very valuable. Also, because of the high strength and light weight of the structural member, a shoring structure can be more easily and more quickly assembled with less parts than necessary using conventional systems of steel pipe, for example.

Since the circumstances and requirements of shoring structures vary widely on an individual basis, it would be impossible to discuss each and every arrangement of the structural member 1 and related structural systems as used in shoring operations. However, it is should become apparent to those skilled in the art, through the above and below discussions of specific applications of the structural member 1 and associated structural systems, that the possible uses of the structural member in shoring and other operations are virtually limitless.

Figure 16B:
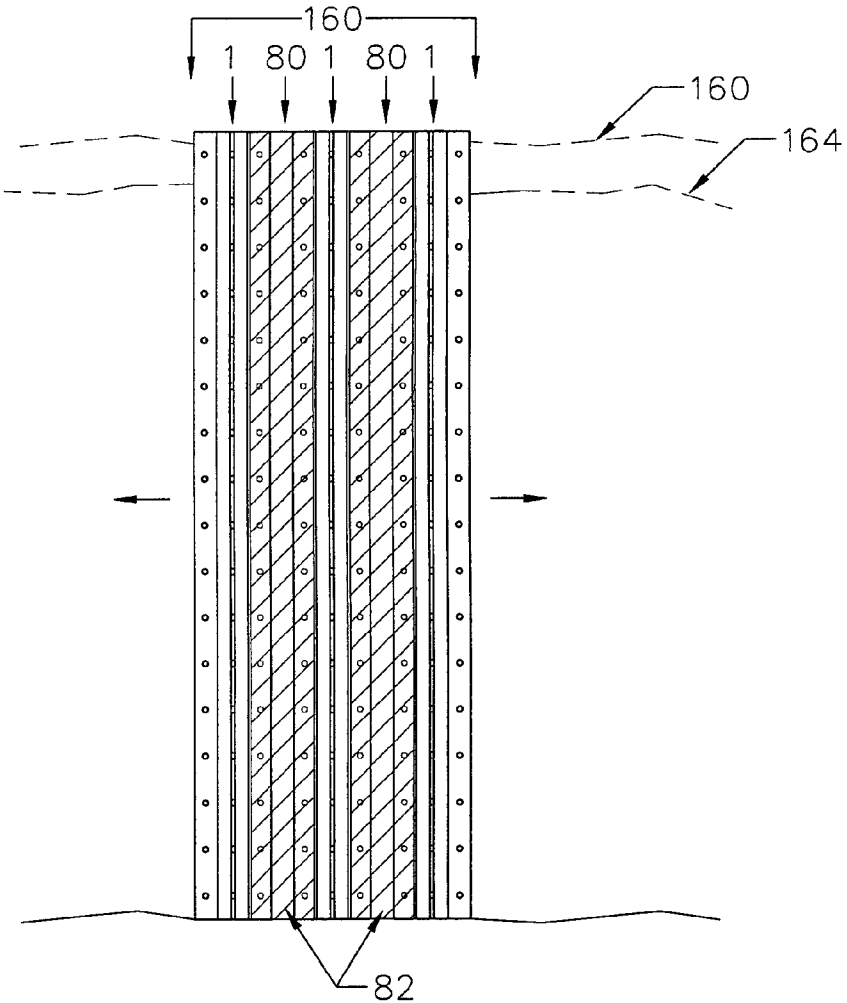
FIGS. 16A and 16B illustrate side and front views, respectively of the subject structural member used in place of sheet piling.
Figure 16A:
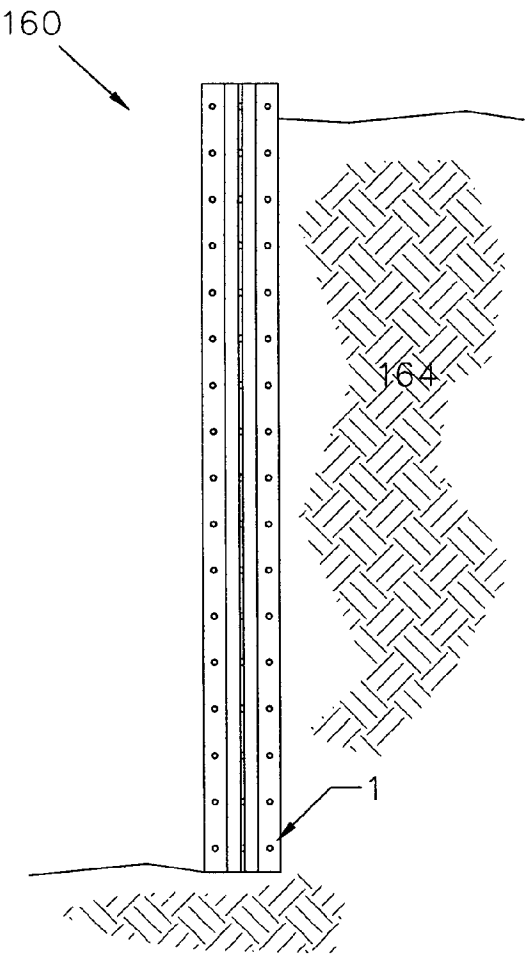

As shown in FIG. 16, as a first example for use in shoring operations, the structural member 1 can be used in lieu of sheet piling and the like (which may otherwise be constructed out of metal, wood or plastic). One embodiment using the subject structural member and attachment elements includes incorporating the structural member 1 into a wall-like arrangement 160 using the double splice element 80 illustrated in FIGS. 8A and 8B. the structural member 1 and the double splice elements 80 are used alternatingly to create a wall 160 that can be used in place of sheet piling. The double splice element 80 may be the entire length of the structural member 1, or may be applied in shorter lengths attached along the length of the structural member 1. Such an arrangement, however, would leave small gaps in-between splice elements equal to the length between the splice elements, approximately the width of the central web 82 of the double splice element. Incorporating full length double splice elements 80 (or alternatively triple 85 or quadruple 87 splice elements, depending on the specific circumstances), reduce gaps in such a shoring operation, and therefore improve retention of the adjacent soil 164, sand, groundwater, etc. One alternative to full-length double splice elements 80 that would approximate the benefits thereof, would incorporate short double splice elements 80 mounted to the structural member, but without any substantial gap between the short double splice elements 80, thus using more splice elements, but not requiring full-length splice elements.

For the above-described sheet-piling structure, anchoring into the surrounding soil may become necessary. Because the subject structural member 1 comprises regularly spaced holes along its length, there are numerous locations to easily attach anchors, or anchoring members to the wall of sheet piling 160.

With respect to other aspects of shoring, there is often a need to raise an existing structure, for one reason or another. One common scenario in which temporary lifting of an existing structure is required, usually within a limited area, is in replacing bridge bearings.

FIG. 17 illustrates a pedestrian bridge 172 supported by two post-shore jack towers 173*a* and 173*b*, the basic design of the towers 173*a*, 173*b* of which can be used in bearing replacement operations of various types of bridges. Depending on the specific application, as is to be expected, the particular size and capacity of structural components will vary, In the embodiment of FIG. 17, a post-shore jack tower 173*a* is constructed directly atop a footing 174, or pad which may be of masonry, wood or other suitable material, and may alternatively include screw jacks 175 positioned below or atop the tower 173*a* to allow leveling of the tower and/or raising of the supported structure, in this case shown as the pedestrian bridge 172. However, a larger, heavier vehicular overpass can be supported, depending on the specific implementation.

Bridge bearings are typically mounted between the concrete buttresses and a steel span of roadway overpasses. The bearings allow the steel portion of the bridge to expand or contract, depending on the ambient conditions (temperature, insolation, etc.), without causing the bridge to buckle. Replacement of these bearings becomes particularly necessary in colder climates where salt is used as a de-icing means on roadways, and is usually heavily applied to bridges and overpasses that typically ice-over before other portions of the same road.

One difficulty that is often encountered in such situations is that the area under bridge roadways is often very confined, such as near the top of a buttress, or the overpass is located above another roadway which, at best, may include a median on which is it possible to arrange a support for a bridge jacking operation. If a median is even present, then chances are the width of the median is on the order of a few feet. With such a limited space, it is difficult to use conventional technologies, such as simple steel pipe, without encroaching upon the below roadway. This is because a relatively large structure is required using conventional systems. In other situations, where there is a limited amount of space between a bridge buttress or support and the above span, it is difficult to maneuver scaffolding pieces of the appropriate load capacity into the proper position, as this is almost always accomplished manually. Since weight savings is realized with the subject structural member 1 over traditional steel pipe, it is easier for workpeople to place the subject structural member 1 and associated pieces (bracing members, etc.) into place than would otherwise be.

Figure 17A:
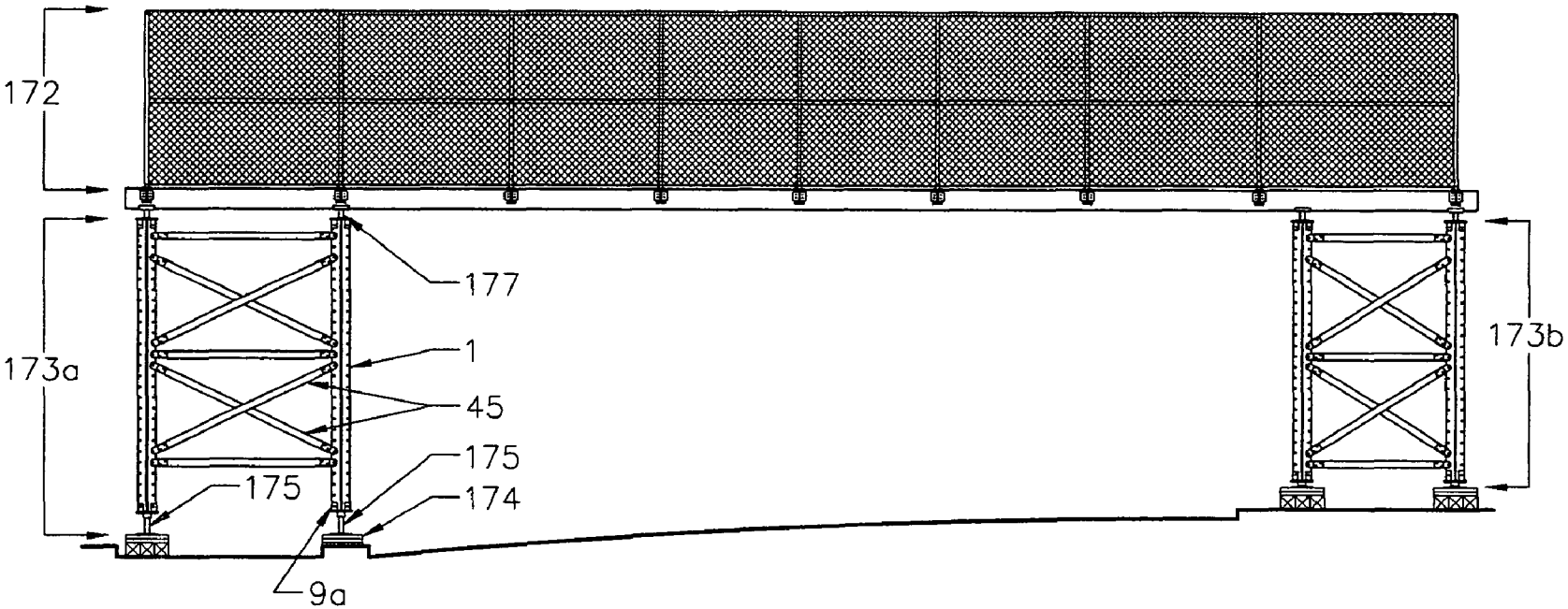
FIGS. 17A and 17B illustrate example tower structures and a pedestrian bridge according the present invention.
Figure 17B:
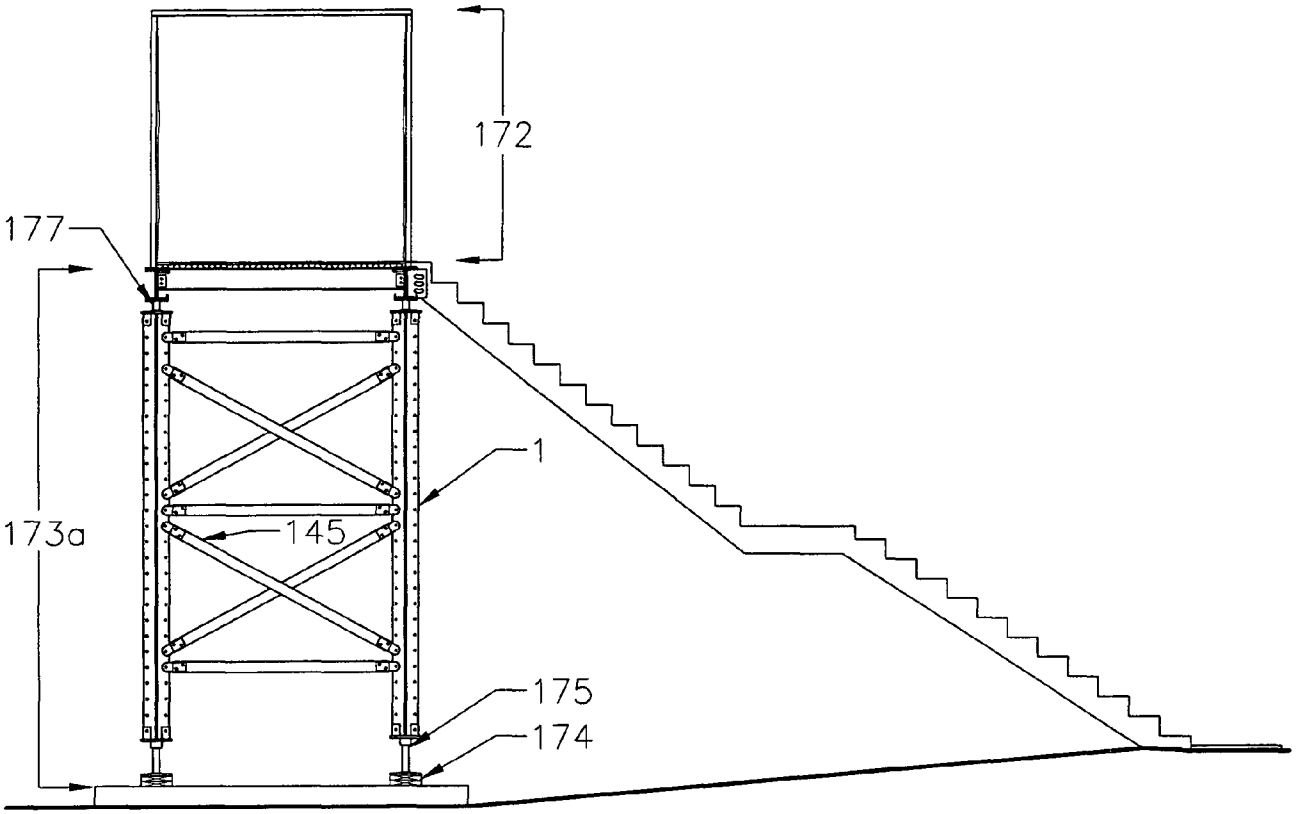

FIGS. 17*a* and 17*b* illustrate tower structures 173*a* and 173*b* incorporating the structural member 1. These tower structures 173*a*, 173*b* benefit from increased strength over traditional pipe and clamp structures due to the strength of the structural member 1 itself and additionally to the interconnection abilities of the flanges 3 that allow secure and versatile bracing.

Due to the high strength and stability of the subject structural member, a smaller support structure is needed for a bridge jacking operation than would be required if constructed from conventional pipe and clamps. As a result, traffic flow is less-likely to be impeded by bearing replacement on an overpass. Also, since space is limited in the area between a buttress and a bridge span, it is more likely that a post-shore jack tower such the those illustrated in FIGS. 17*a* and 17*b* would fit in such an area, due to the decrease in required size. Moreover, since the time required to set up structures with the subject structural member 1 is less than with conventional systems, any length of time during which traffic diversion may be necessary, is reduced.

Another common scenario in which lifting of an existing structure is needed is in buildings that are settling for one reason or another. Usually, it is desirable to correct any severe settling in a structure. In such a case, one or more appropriate locations for lifting the structure will be determined, after which footings are created in those locations. After this, a steel lally column is typically inserted between the structure and a screw jack resting on the footing. However, such steel columns are usually rather heavy and are, out of necessity, almost the full floor height of the location where the structure is being lifted. Because of the relatively light weight of aluminum, use of the subject structural member 1 in lieu of a steel lally column provides substantial benefits such as ease of insertion of the column because of its reduced weight. This attribute of the structural member 1 is beneficial to any application.

Figure 11:
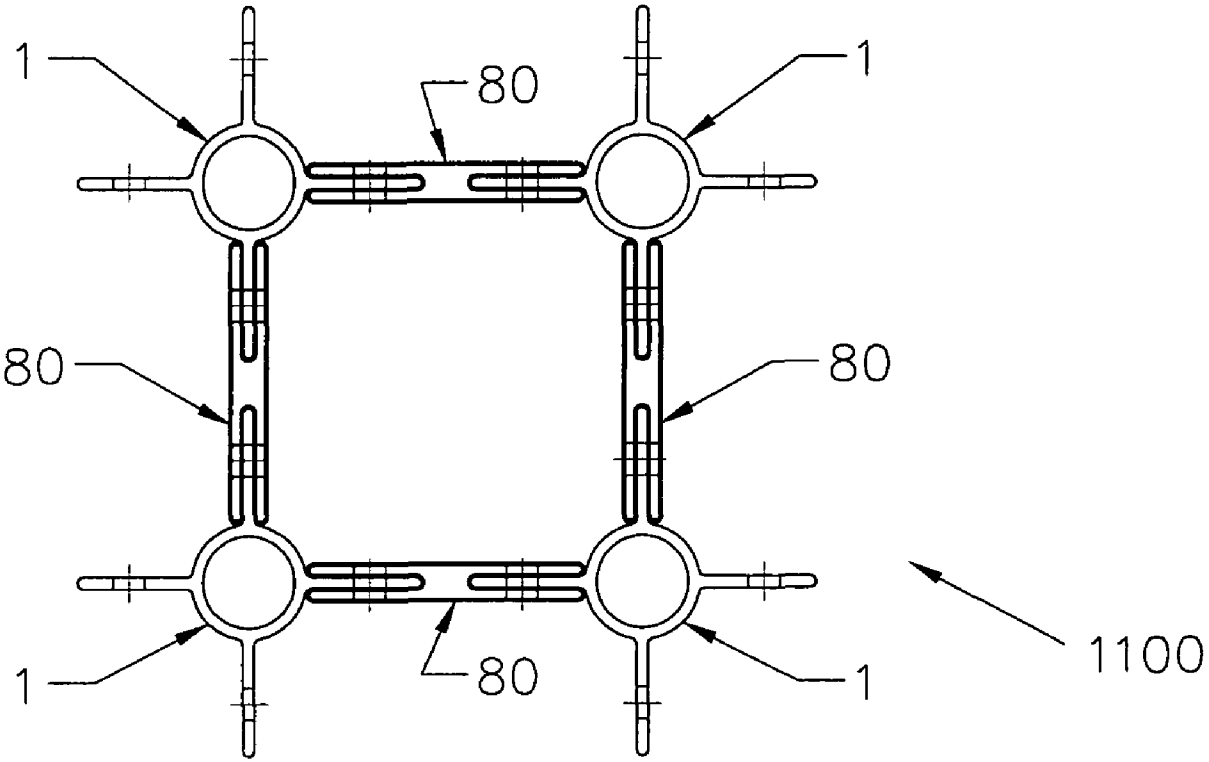
FIG. 11 is a cross-sectional view of a truss or column assembly according to one embodiment of the present invention.

The towers 173 of FIGS. 17*a* and 17*b* can be extended to any length, provided that the structure is appropriately designed for the anticipated loads. As an alternative to this structure, in certain circumstances arrangements such as that shown in FIG. 11 are possible. FIG. 11 illustrates a cross-section of a truss/tower structure 1100 that can be used as a vertical column member or as a horizontal truss. In cross-section, this embodiment features four structural members 1 are arranged at respective vertices of a square, connected to one another by four double splice elements 80 constituting the sides of the square. Such an arrangement results in a very strong and still relatively light structure that can be used independently or in combination with other elements in a larger structure. Again, benefits of using the structural member 1 in such a manner include that the structural member 1 is versatile, light, strong and easily maneuverable, and even stronger when combined in multiples as shown in FIG. 11.

Figure 18B:
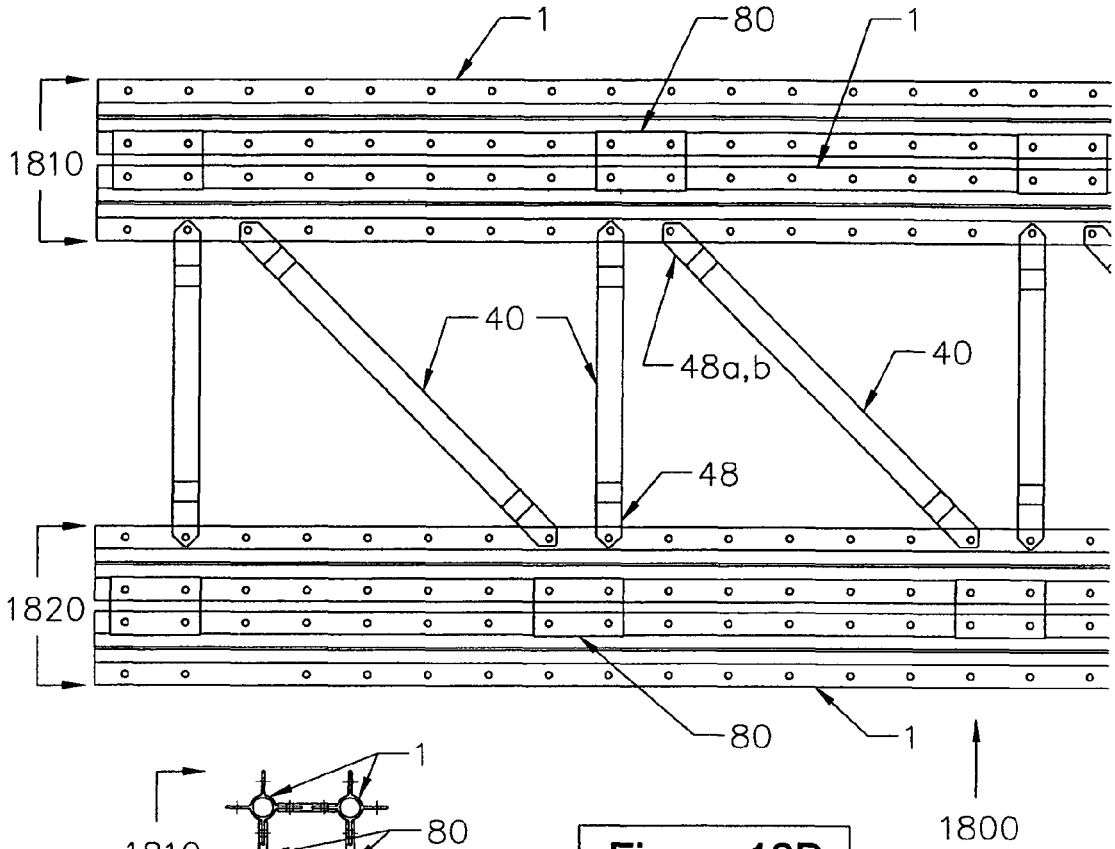
FIGS. 18A, 18B, 19A, 19B, 20, 21A and 21B illustrate example truss assemblies according to the present invention.
Figure 18A:
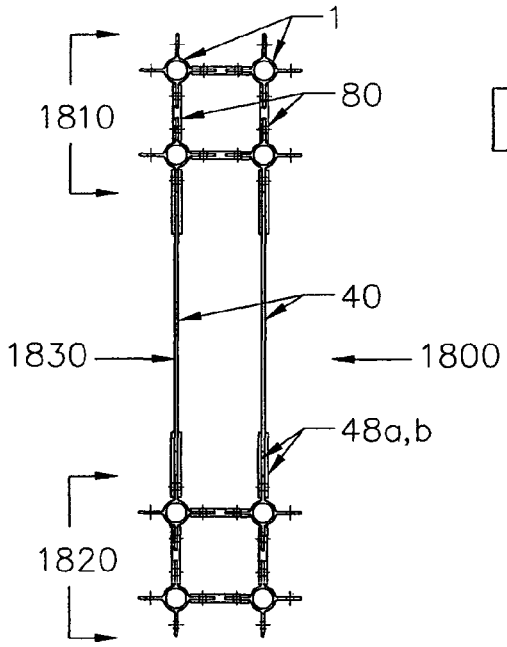

FIGS. 18*a* and 18*b* illustrate an example truss 1800 in which the truss/tower structure 1100 constitutes top and bottom flanges 1810 and 1820. As with the beam structure 1100, the structural members 1 are interconnected by means of the double splice element 80, spaced at regular intervals along the length of the beam structure 1100, as most easily seen in FIG. 18*b*. In this embodiment, the top and bottom flanges 1810 and 1820 are connected via bracing members 40, which in this embodiment include a double shear end 48. In this embodiment, the double shear end includes two plates 48*a,b* attached to each side of each terminal end of the bracing member main body 40.

Figure 19B:
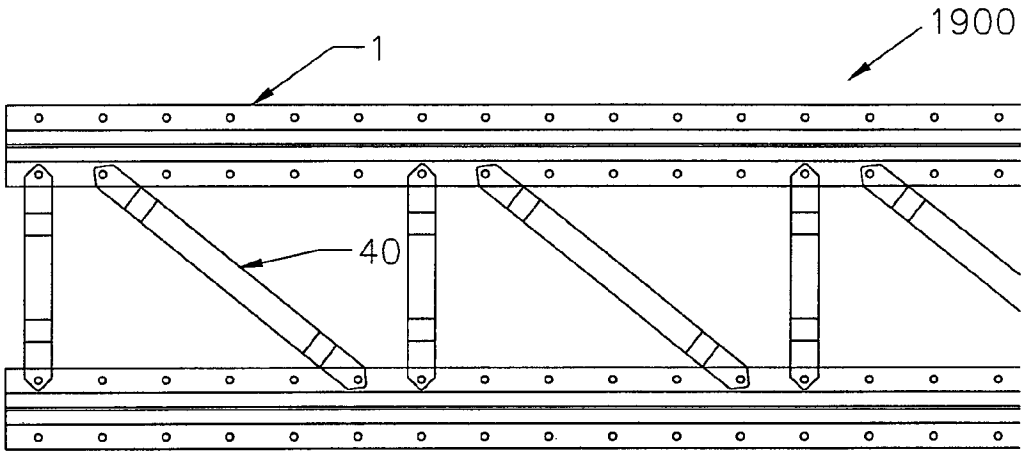
Figure 19A:
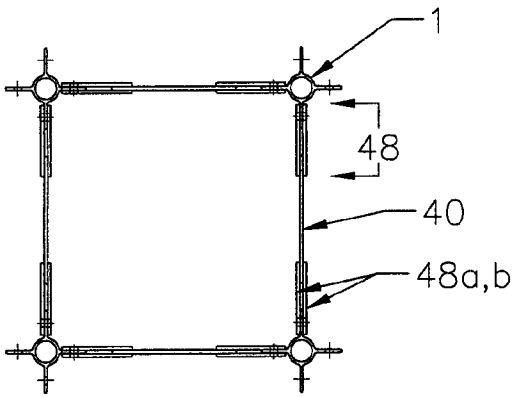

An alternative truss arrangement to the above described is shown in FIGS. 19*a* and 19*b*. Truss 1900, is in cross-section a square with each of four structural members 1 defining a corner of the square. In this embodiment, each side of the square is defined by bracing members 40 that form an open latticework on each side, as is best seen in the side view of this embodiment shown in FIG. 19*b*. Use of the bracing members 40 allows an economical expansion of the outer dimensions of the truss 1900, in comparison with use of the double splice member 80, which is only practical for splicing structural members 1 that are arranged closely together. Like many trusses described herein, the truss 1900 can be used in a horizontal orientation as a beam, or in a vertical orientation as a tower or support/shoring structure.

Figure 20:
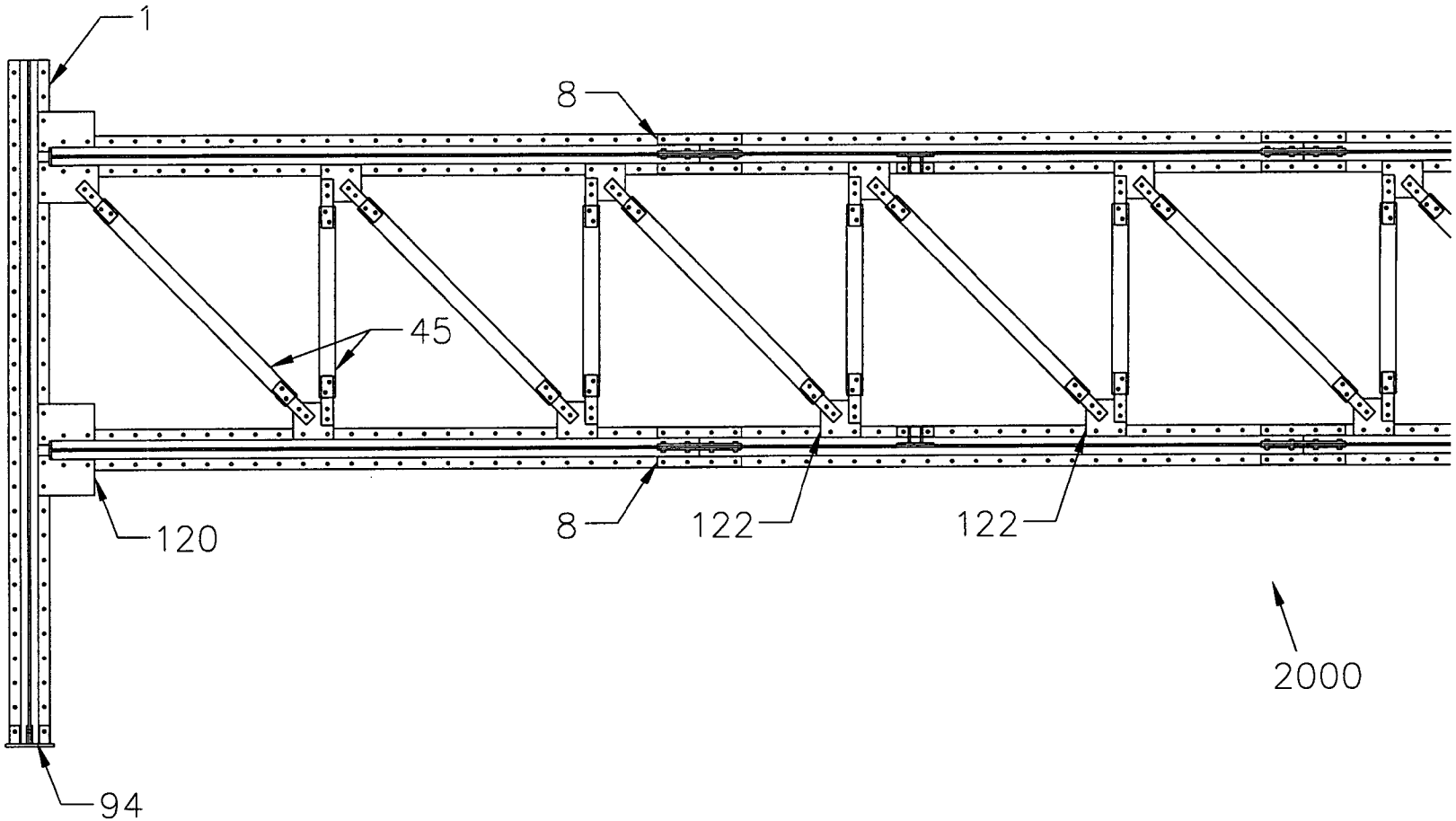

FIG. 20 illustrates a further embodiment of a truss 2000 using the subject structural member. The structural member is used in this embodiment as both the vertical and horizontal members. The gusset plates 120 attach the vertically oriented structural members 1 to the horizontally oriented structural members 1. To create a longer truss than each individual structural member 1, the horizontally oriented structural members 1 are connected end-to end by flat connection adapters 8, though other connectors, such as the single splice element 60 are applicable. To achieve a higher load capacity without buckling, this embodiment incorporates square tubular bracing members 45 attached, via gusset plates 122, to the structural members 1.

Figure 21B:
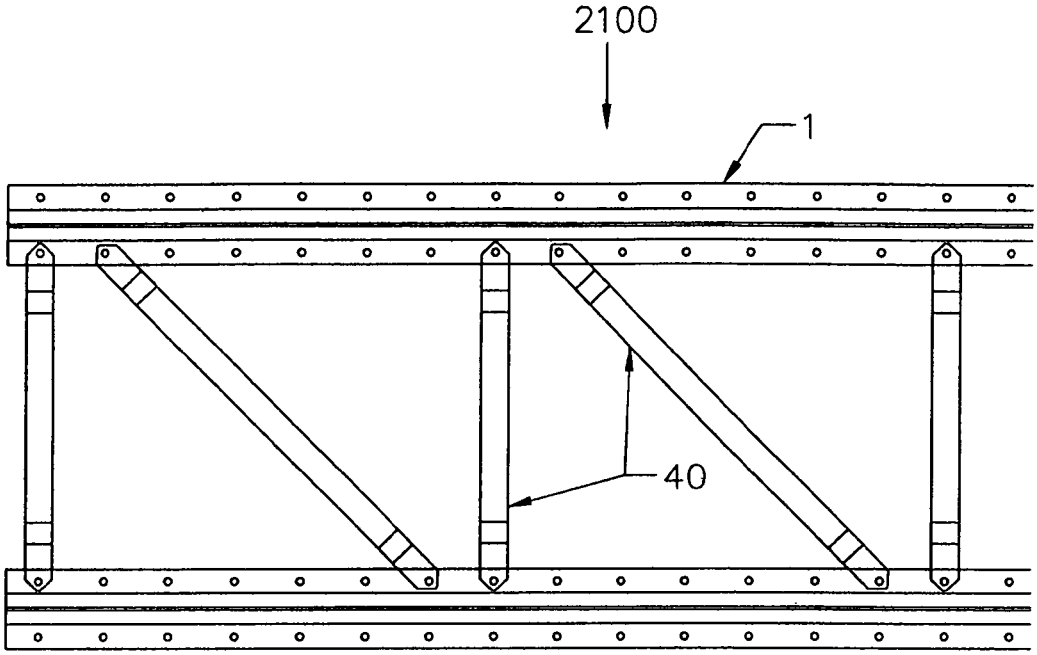
Figure 21A:
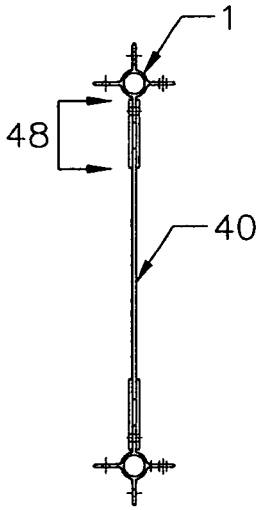

FIG. 21 a illustrates an end view of a truss 2100, similar to truss 2000, but utilizing flat bracing members 40. FIG. 21*b* illustrates a side view of the same truss 2100 in which it is easy to appreciate the relative simplicity of the structure.

Because of their light weight, the above-described trusses can advantageously be applied to the field of theatrical lighting as light bars. Other aspects of theatre would see the subject structural member 1 in use as scaffolding in readying sets, maintaining theatres, for use as a set itself, and in other capacities.

Figure 22:
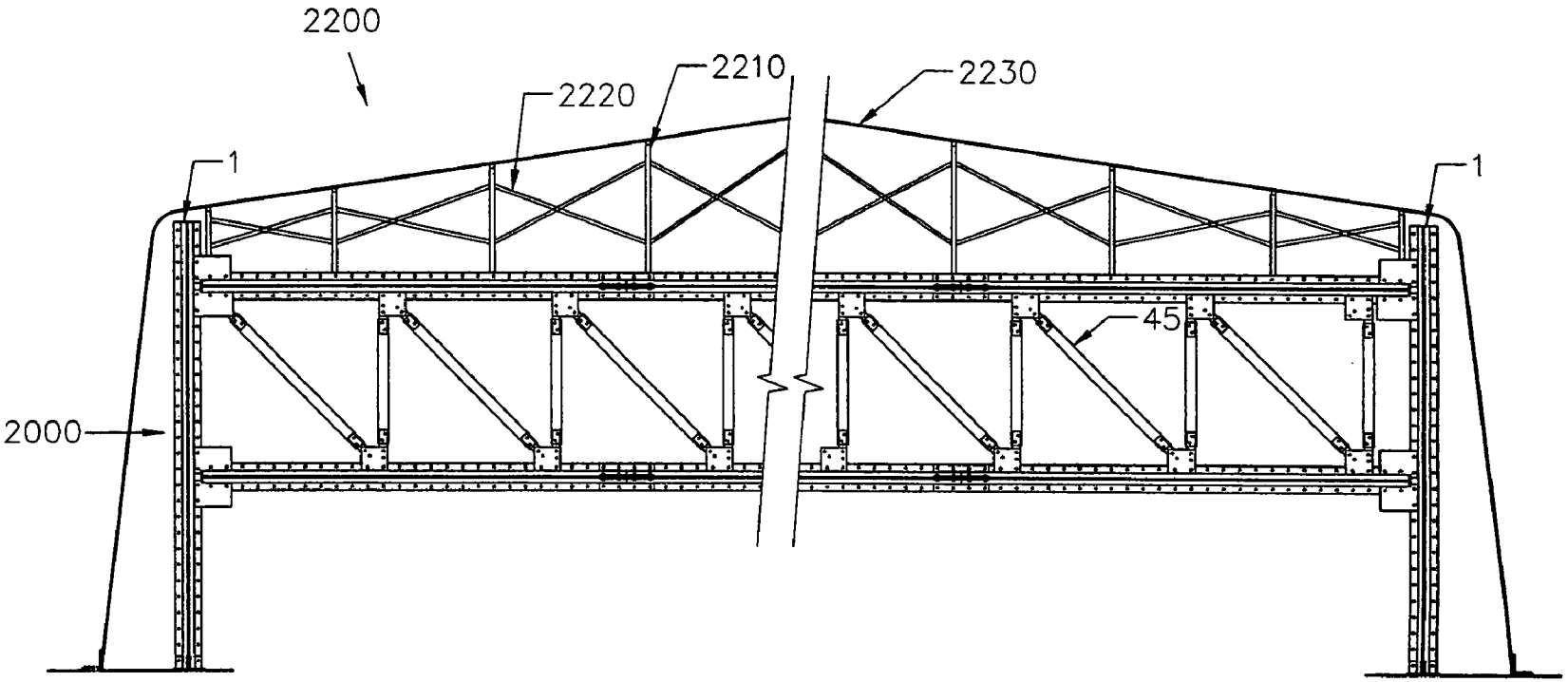
FIGS. 22, 23A and 23B illustrate an example roof structure according to the present invention.

FIGS. 22-24 illustrate side, end and top views, respectively, of a roof structure 2200 that may be used in a temporary or permanent capacity. In this embodiment, the truss 2000 of FIG. 20 is used as a main support, mounted on structural members 1. Of course, the truss 2000 could alternatively be supported by conventional I-beam columns, concrete pillars or the like.

With the truss 2000 spanning the distance between vertical structural members 1, conventional pipe and clamp columns 2210 and braces 2220 are used in this embodiment to construct a sloping roof structure upon the truss 2000. A cover 2230, which is placed over the sloping portion effectively seals out the weather when used as a temporary roof structure. It is to be understood that varying lengths of the structural member 1 could alternatively be used instead of the pipe and clamp columns 2210 and braces 2220.

Figure 23A:
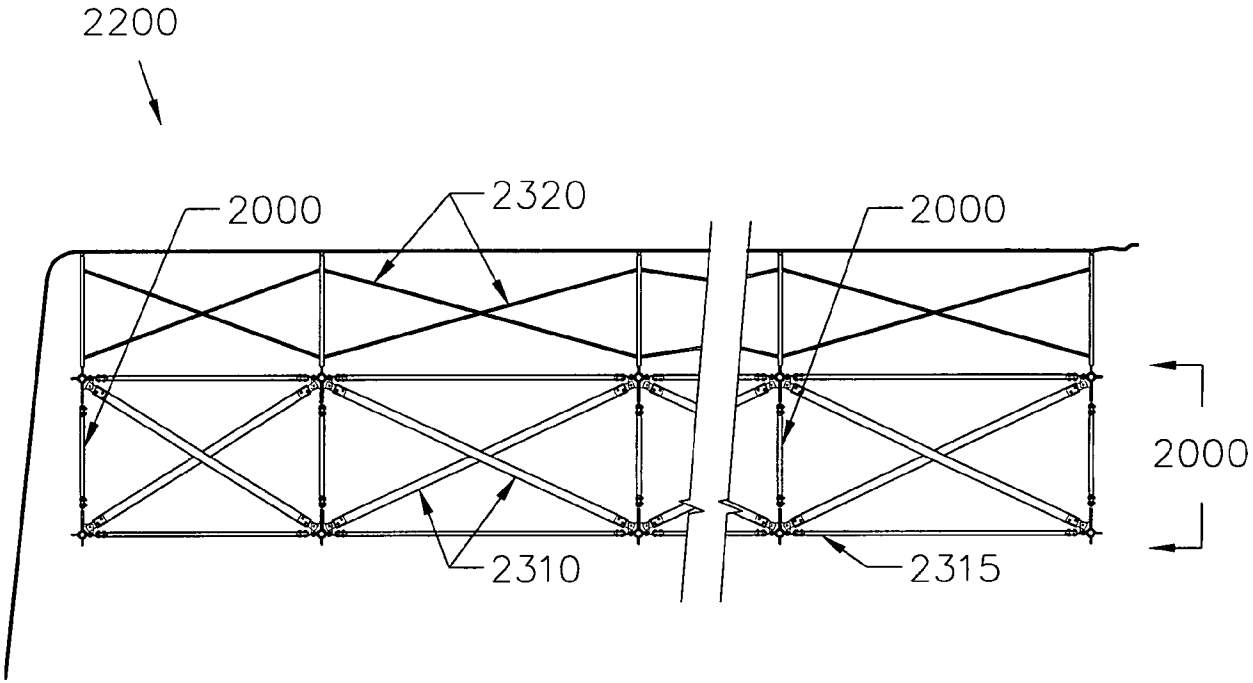
Figure 23B:
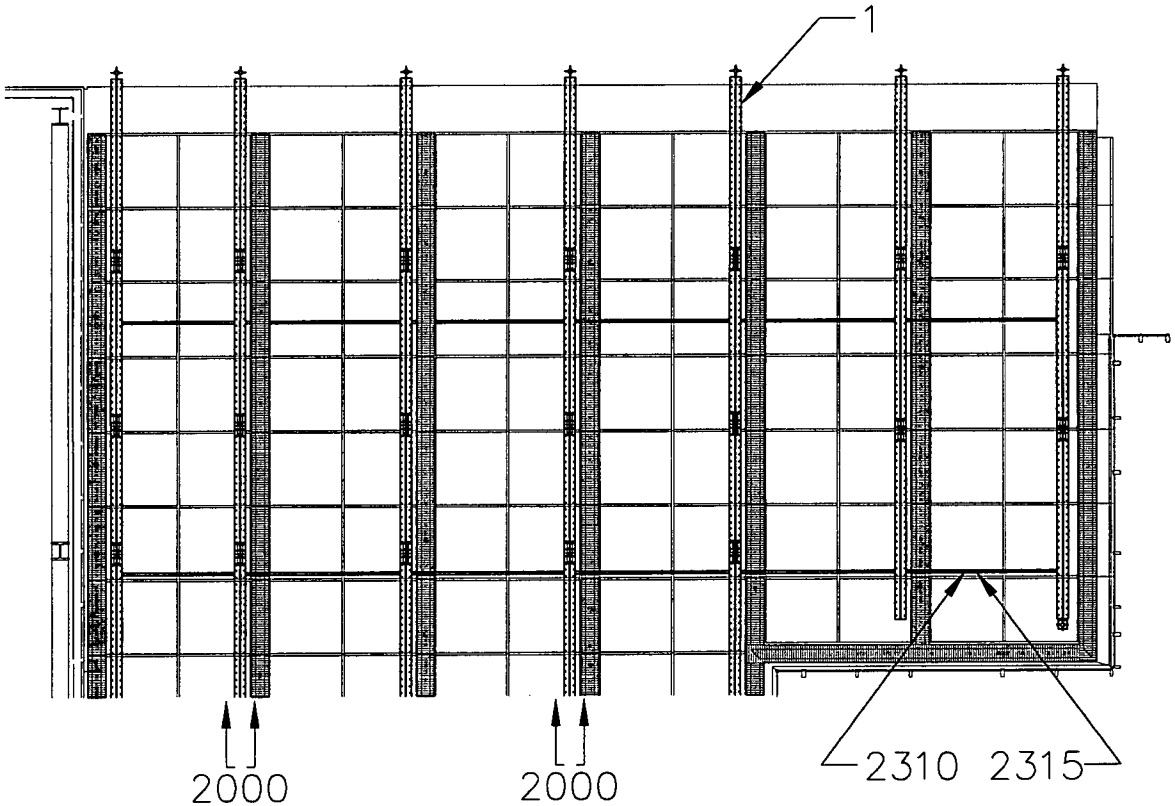

FIG. 23A illustrates an end view of the same roof structure 2200. As seen from the end, each truss 2000 is braced against at least one adjacent truss 2000 by way of cross-braces 2310, and horizontal braces 2315. FIG. 23B illustrates a top view of the roof structure 2200, which further illustrates the arrangement of the structural components in this embodiment.

Figure 24B:
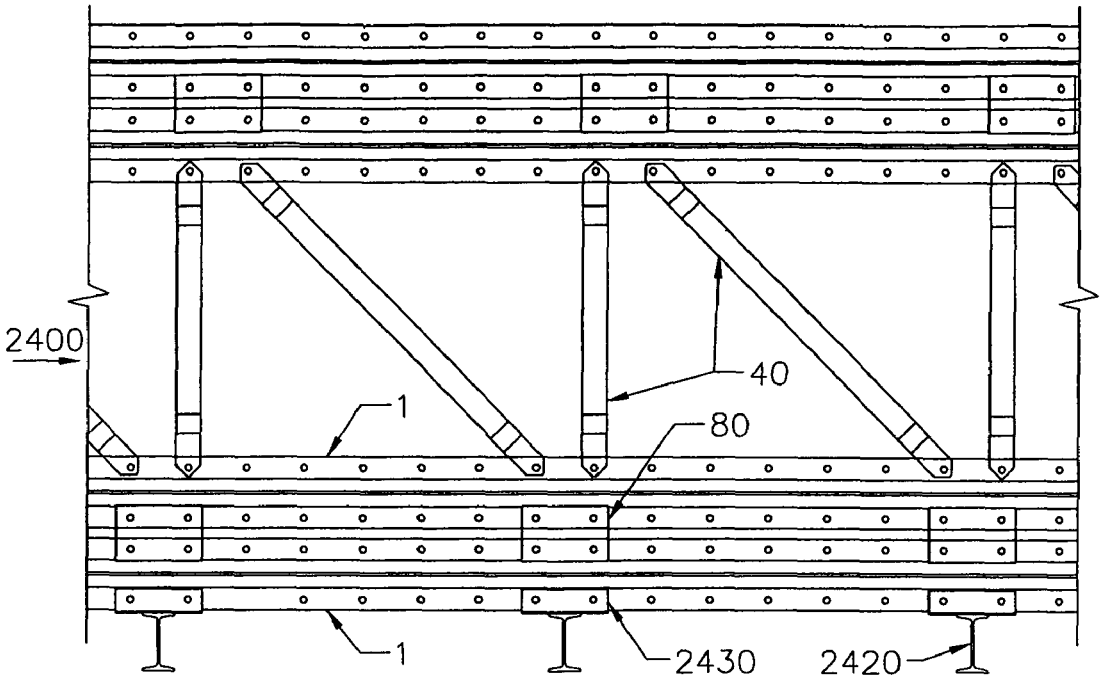
FIGS. 24A and 24B illustrate an example bridge structure according to the present invention.
Figure 24A:
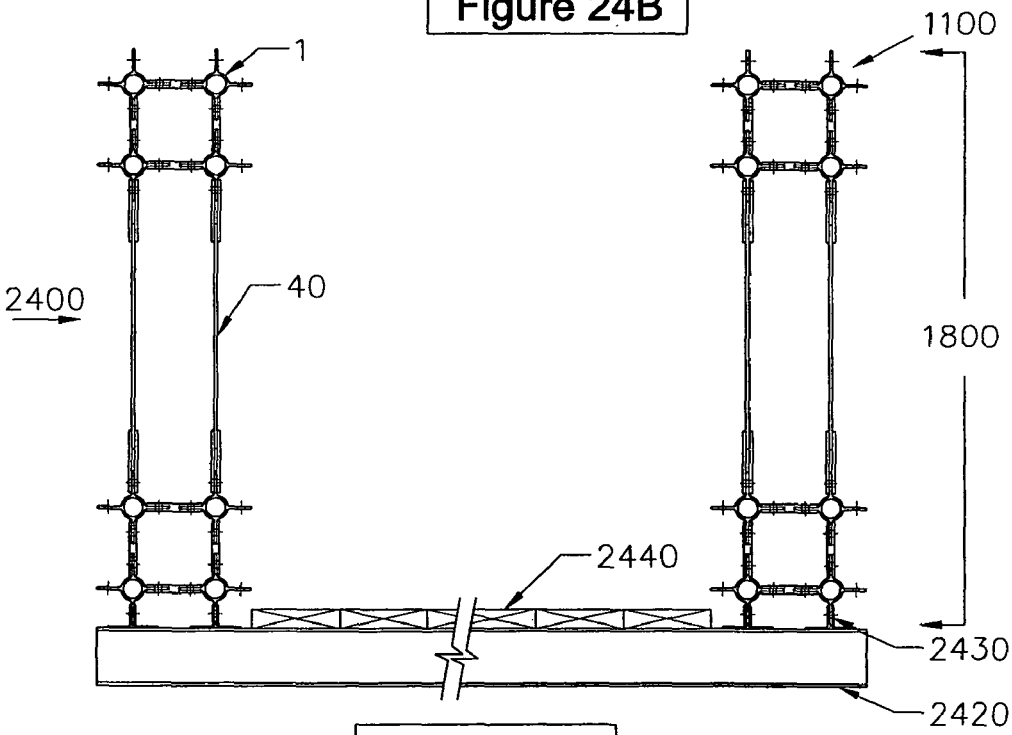

An additional application for the truss 1800 illustrated in FIGS. 18*a* and 18*b*, and its component truss 1100 is in a Bailey-type bridge. FIGS. 24*a* and 24*b* illustrate end and side views, respectively, of a Bailey type bridge 2400 utilizing the subject structural member 1.

Bailey bridges were developed in order to easily place temporary bridges in hard to reach locations without the need for any large or unusual equipment. Bailey bridges have been used in combat zones since World War II in order to quickly erect additional or replacement bridges. For this reason, the ability for quick implementation, easy assembly and relatively light weight are essential. Traditional Bailey bridges are typically assembled on site, and then cantilevered over and extended across a gap which they are to span. They are usually counter-weighted with a heavy tractor, or the like, until the extended end reaches the opposite side of the gap.

As shown in FIGS. 24*a* and 24*b*, a Bailey-type bridge 2400 incorporates horizontal truss members 1100 (described in detail above), that themselves are constructed from four structural members 1 joined by their flanges via double splice members 80. These horizontal truss members 1100 are arranged such that one is at the top and one at the bottom of each of the left and right truss assemblies 1800 (also described in detail above). From these left and right truss assemblies 1800, are suspended I-beams 2420 to support a roadway 2440 (or other platform). The I-beams are attached to the truss assemblies 1800 by way of brackets 2430, and the roadway 2440 is laid across the I-beams 2420, forming a usable bridge structure. Naturally, I-beams need not be used, and instead the structural member 1 adapted to take the place of the I-beams of this embodiment.

Since the individual components are light, even compared to traditional Bailey-bridges, construction is further facilitated. When fully disassembled, the heaviest component of the bridge 2400 is likely to be the I-beam 2420 or the structural member 1 itself. Accordingly, implementing the bridge 2400 in a remote location or in an area difficult to reach, is easier than it would be to implement another type of bridge, even Bailey bridges, in the same location.

Figure 25B:
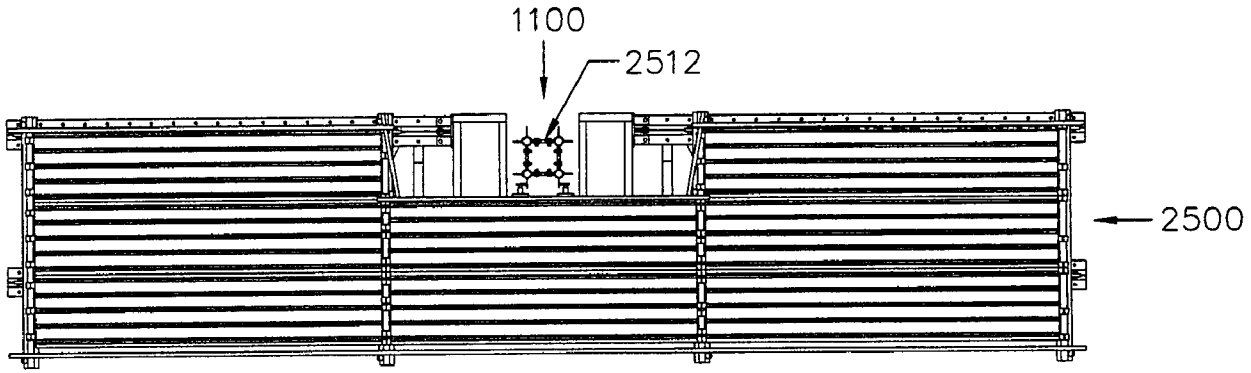
FIGS. 25A and 25B illustrate an example mast-climber apparatus according to the present invention.
Figure 25A:
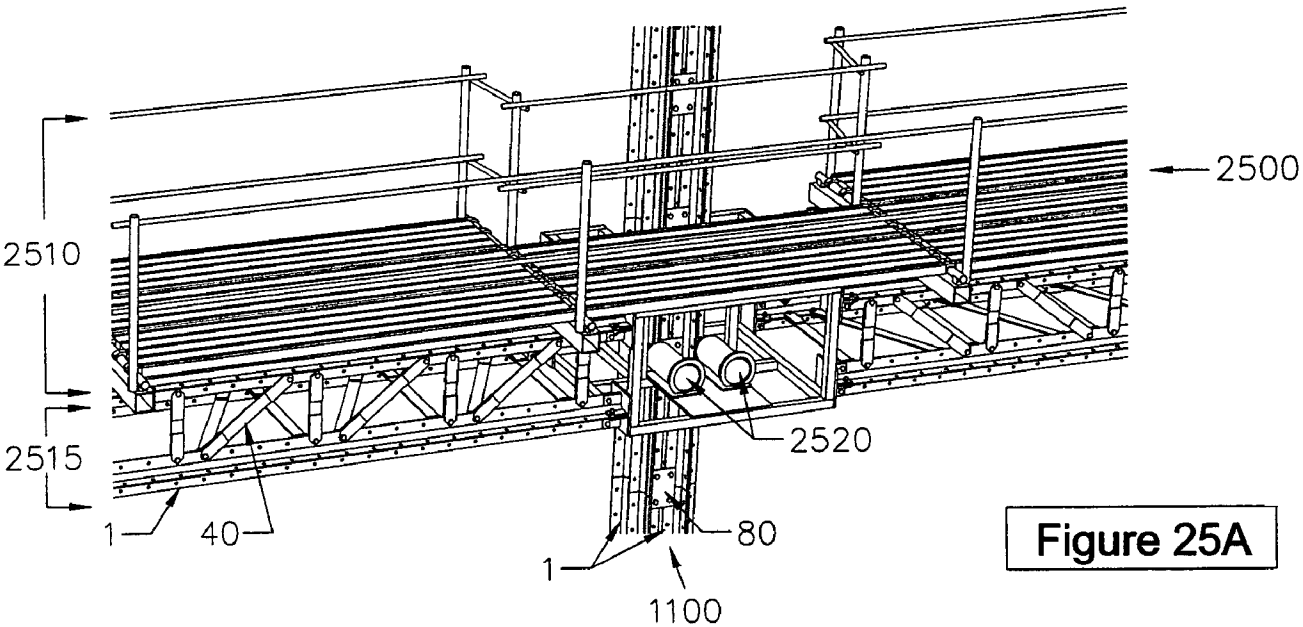

FIGS. 25*a* and 25*b* illustrate a mast-climber apparatus 2500, also known as a "Heck lift". The mast-climber 2500 includes as a support, one or more masts 2512, which in this embodiment are manufactured from vertically-oriented truss assemblies 1100, such as that described in more detail above in connection with FIG. 11. A movable platform 2510 includes a structure that consists mainly of an underlying truss 2515, which is itself comprised of the structural member 1 and bracing members 40. Typically, and in this embodiment, one or more motors 2520 are employed to move the platform 2510 up and down the mast 2512. The motors 2520 include pinion gears at one end that each engage a respective rack of teeth that are attached to or integral with the mast 2512. The racks, according to the present embodiment, are typically integrated with or attached to (e.g., by bolting) to flanges 3 of the structural member 1. The racks can be arranged either on the inside faces of the flanges 3 or on the outside faces of the flanges 3.

As set forth above, the structure of the truss 1100 includes longitudinally oriented structural members 1, arranged with one at each corner forming a square cross-section. The structural members 1 are joined on each side with the double splice member 80, also described above. Together, these components are the primary structural components of the mast 2512 illustrated in FIGS. 25*a* and 25*b*. In a preferred embodiment, these members are bolted together, and are not welded. In contrast, conventional mast-climber devices utilize a mast that is constructed from welded components. This distinction is not trivial in its implications, for the following reasons.

In the City of New York, if a mast-climber of conventional design and construction having welds anywhere in its structure is put into service, it must be certified safe for use. The City of New York requires that such structures be tested for cracks yearly (For example, with a "magna flux" device), to assure that any welds are holding strong and that the structure is safe. Such testing must be repeated yearly in the City of New York to gain the required recertification. As one might expect, such procedures are time-consuming and costly (currently approximately $10,000 per testing), both in direct time for testing, and in loss of lift operation time consumed by the testing.

Since the above-described mast-climber is supported by a mast 2512 incorporating the subject structural member 1 arranged in the novel configuration also set forth above, notably, a configuration without welds, said mast 2512 would not require annual testing for cracks (for example, with a "magna-flux" device) in order to achieve recertification. It is likely, depending on the locality, that only a standard visual inspection would be required, without the use of such specialized equipment or testing.

Similar platforms, without the supporting truss assembly 1100 can alternatively be used as a suspended window-washing platform (also known as a "hung rig"), such as those used in high-rise buildings, with the appropriate attachment mechanisms mounted thereto in any appropriate manner. Such applications are discussed below in connection with FIGS. 31A, 32 and 33.

Figure 26:
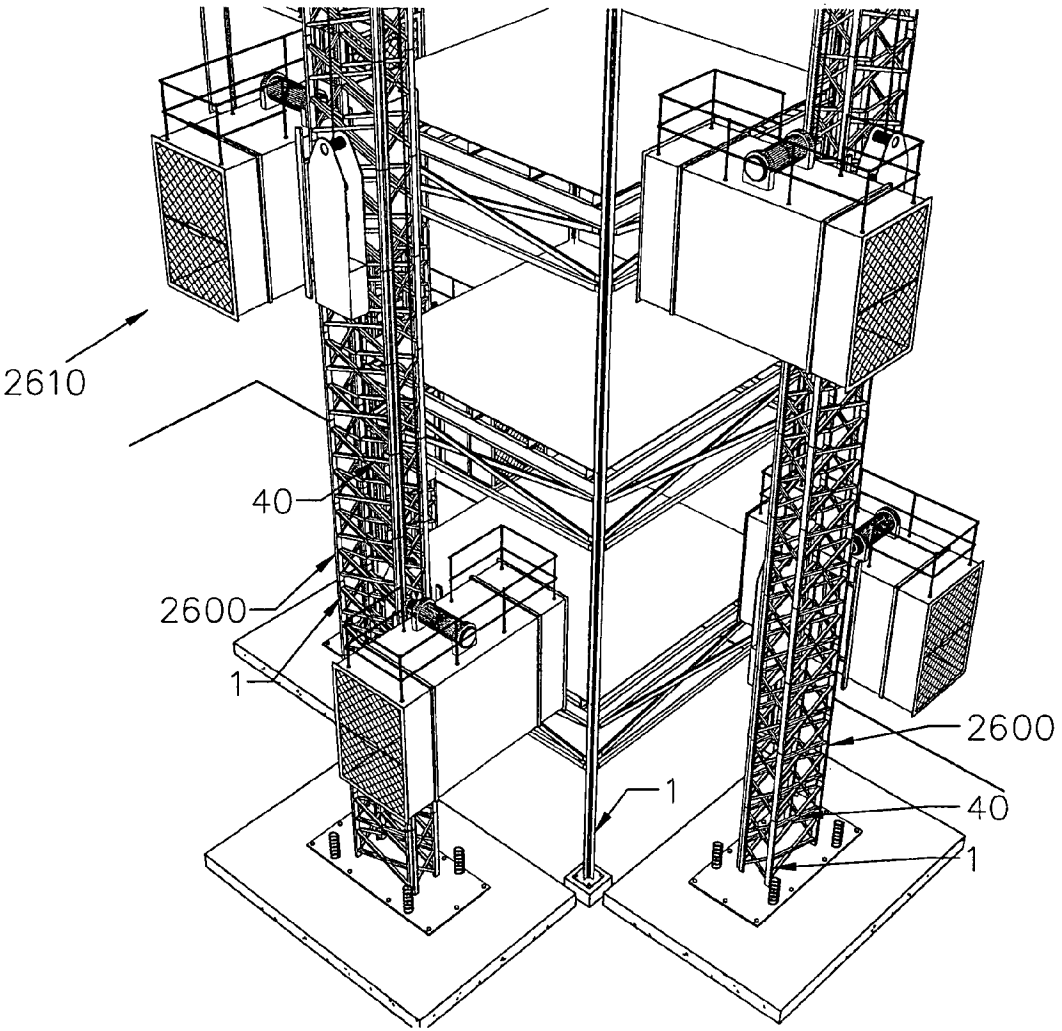
FIG. 26 illustrates an example embodiment of a hoist tower according to the present invention.

FIG. 26 illustrates the structural member 1 being used in a hoist tower 2600, but instead of being joined by double splice members 80, the structural members 1 are joined by bracing members 40, forming a tower structure 2600, upon which lift cabs 2610 operate. Such structures as tower structure 2600 can be used as crane support towers as well as hoist towers. When used in a typical arrangement as a crane support tower, vertical sections can be pre-assembled and lifted into position in the same manner as conventional crane support tower sections.

Figure 27:
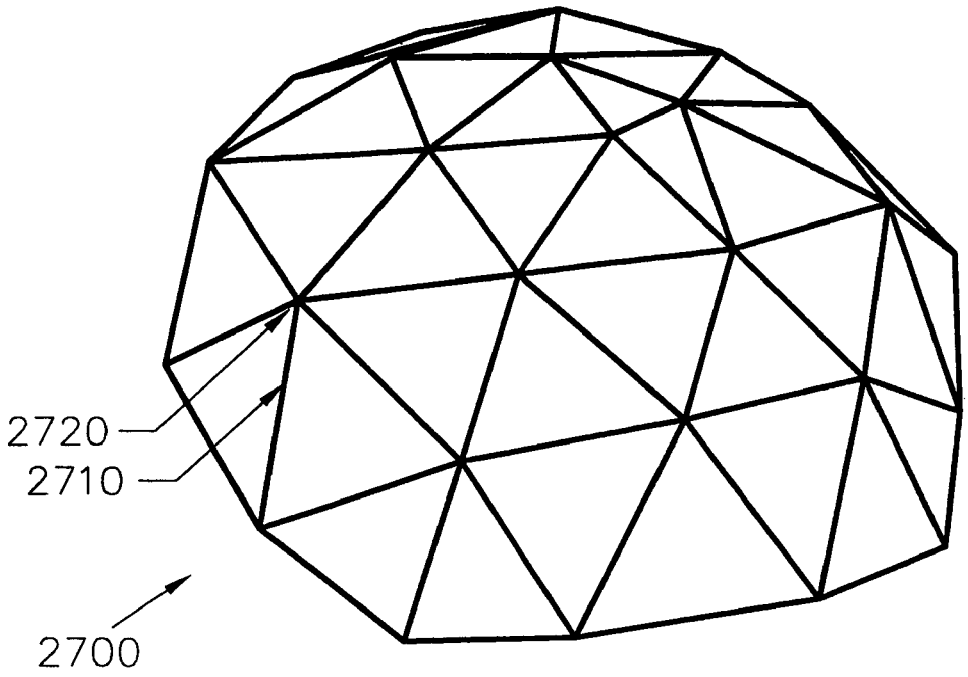
FIGS. 27 and 28 respectively illustrate a geodesic dome elevation and a structural unit for the geodesic dome using the subject structural member.
Figure 28:
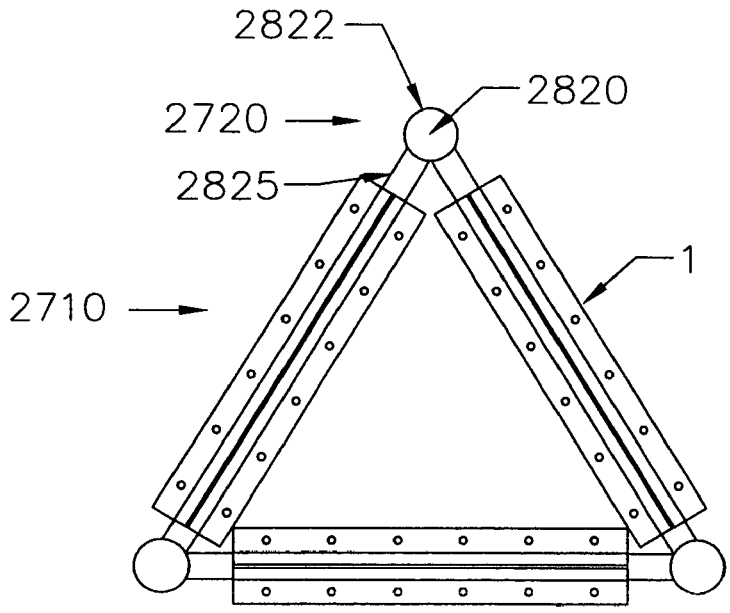
Figure 30:
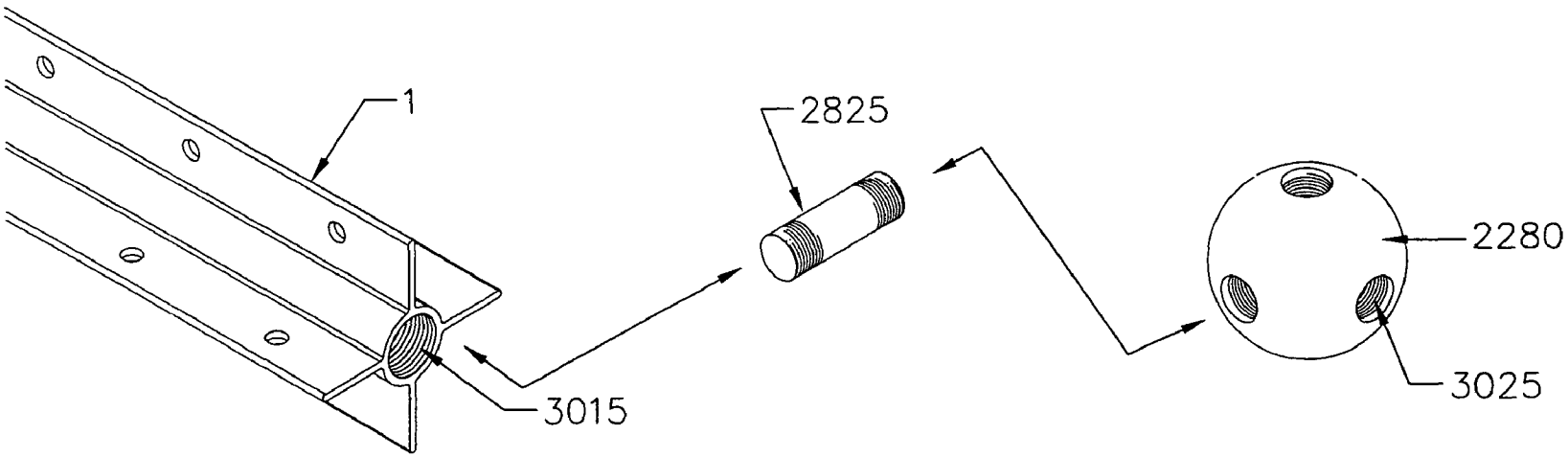
FIG. 30 illustrates an example arrangement for attachment of components of the subject structural member.

FIGS. 27 and 28 Illustrate a geodesic dome 2700 elevation and a geodesic dome structural unit 2710, respectively. Conventional geodesic domes rely on the structural integrity of panel inserts to impart rigidity on the overall structure by distributing the loads from panel to panel, and ultimately to the ground. Using the subject structural member 1, as best seen in FIGS. 28 and 30, each structural unit 2710 can benefit from the strength of the structural member 1. Each structural member 1, defining a side of each structural unit 2710, is joined to other structural members 1 at node points 2820.

In contrast with conventional geodesic dome designs, a geodesic dome utilizing the subject structural member 1 is able to support itself without needing to rely on the strength of the panels themselves. Rather, simply the structural unit 2710 is used, which provides all the necessary strength. As a result, higher loads can be withstood. Alternatively, panels having lower strength than would otherwise be used can be utilized. For example, panels of glass may be used, which otherwise would not be of sufficient strength to allow a geodesic dome consisting solely of glass. However, with the underlying structure afforded by the subject structural member 1, this becomes possible. Additionally, as a matter of convenience, the flanges 3 are advantageously arranged so that a panel can simply be placed upon them, and attached by an appropriate means (bolting, adhesive, etc.).

A node point can take on a variety of forms. As shown in FIGS. 28 and 30, the node point 2820 includes a connection point 2822 and a plurality of connection studs 2825 for connecting the structural member 1, but even more connection studs are conceived. In particular, a node point 2820 may alternatively include five connection studs 2825 for a central node in the geodesic dome 2700, or alternatively still, four connection studs for nodes at ground level, along the perimeter of the geodesic dome 2700.

In this embodiment, the connection studs 2825 are inserted into the tubular portion of the structural member 1. The structural member 1 may have an internal threaded surface 3015 for mating with a threaded connection stud 2825, which in-turn mates with an internal threaded surface 3025 of the node point 2820. Depending on the specific structure, similar node points may be implemented. That is, such connection points need not be limited to a dome structure, but can be applied to virtually any structure. Alternatively, the connection may include a set screw or screws, or another suitable connection and securing means. As an alternative to fitting within the structural member 1, an alternative embodiment of the node point 2820 fits over the end of each structural member, and yet another embodiment includes parts that are inserted within, and parts that are inserted over the end of each structural member 1.

Figure 29:
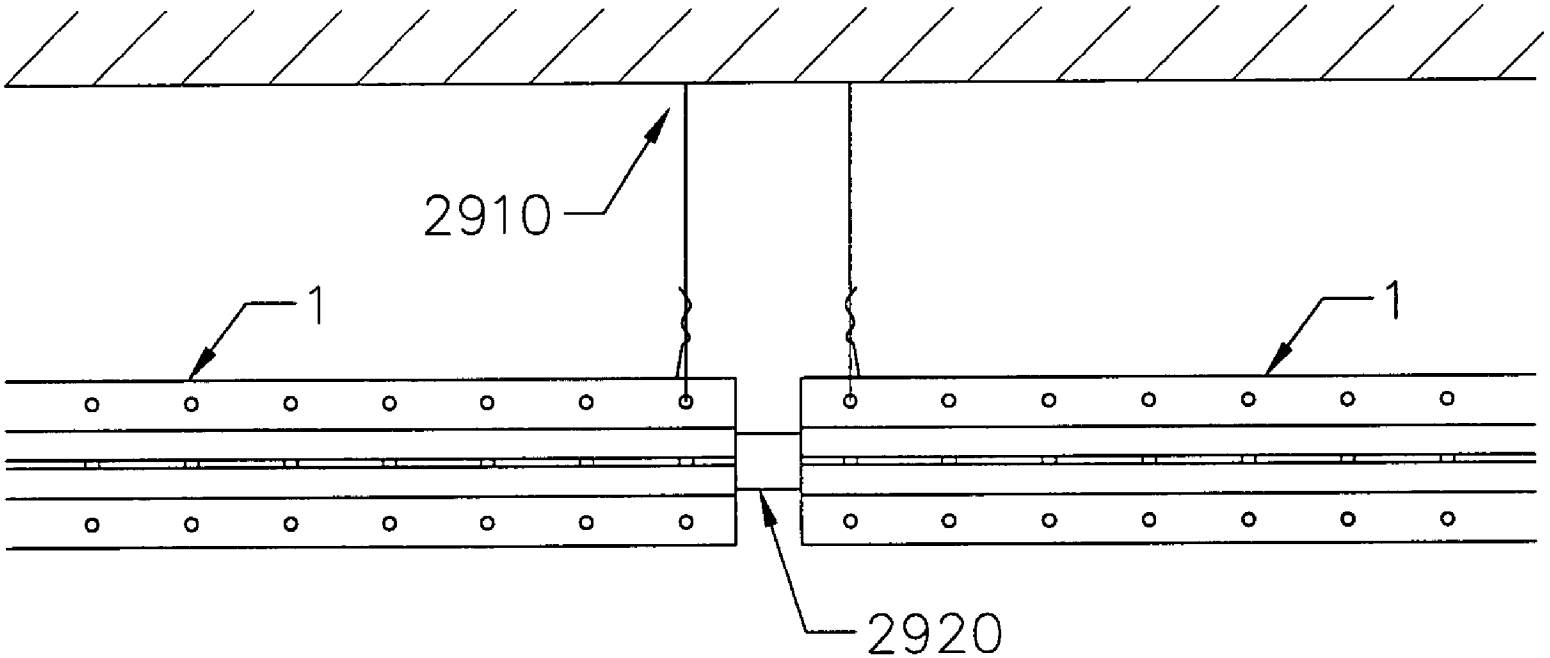
FIG. 29 illustrates an example use of the structural member as a conduit for carrying cables or fluid

Since the structural member 1 benefits from increased rigidity over traditional cylindrical pipes, the structural member 1 is advantageously used as a replacement for traditional fluid-carrying pipe or cable conduits, as shown in FIG. 29. Where traditional pipe and conduits require regular attachment to another structure to maintain their integrity, since the structural member 1 has increased rigidity as compared with a simple cylindrical pipe, the structural member 1 used for these purposes requires less attachment points 2910, and perhaps none, depending on the length of span and the particular embodiment.

The structural member is typically constructed out of aluminum, but the use of other metals is possible. If used as a conduit for drinking water, copper may be used. If desired, the structural member may be a composite, having a tube 2 made from copper, and flanges 3 made from another metal. Such a design would be useful where cost savings are desired, or if the tube 2 is made from a relatively soft material such as copper.

If used as a conduit for fluids or cabling, adjacent structural members 1 can be attached to one another via internal couplings, such as threaded couplings 2920. Alternatively, the ends of each structural member 1 can be manufactured so as to be lacking a portion of the flanges 3 at that point, to enable standard soldering techniques used in plumbing. Then, since the overall structural integrity is somewhat compromised at these joints, it can be there that the conduits are supported to surrounding structure, with hangers 2910, straps or the like.

Figures 31A, 31B:
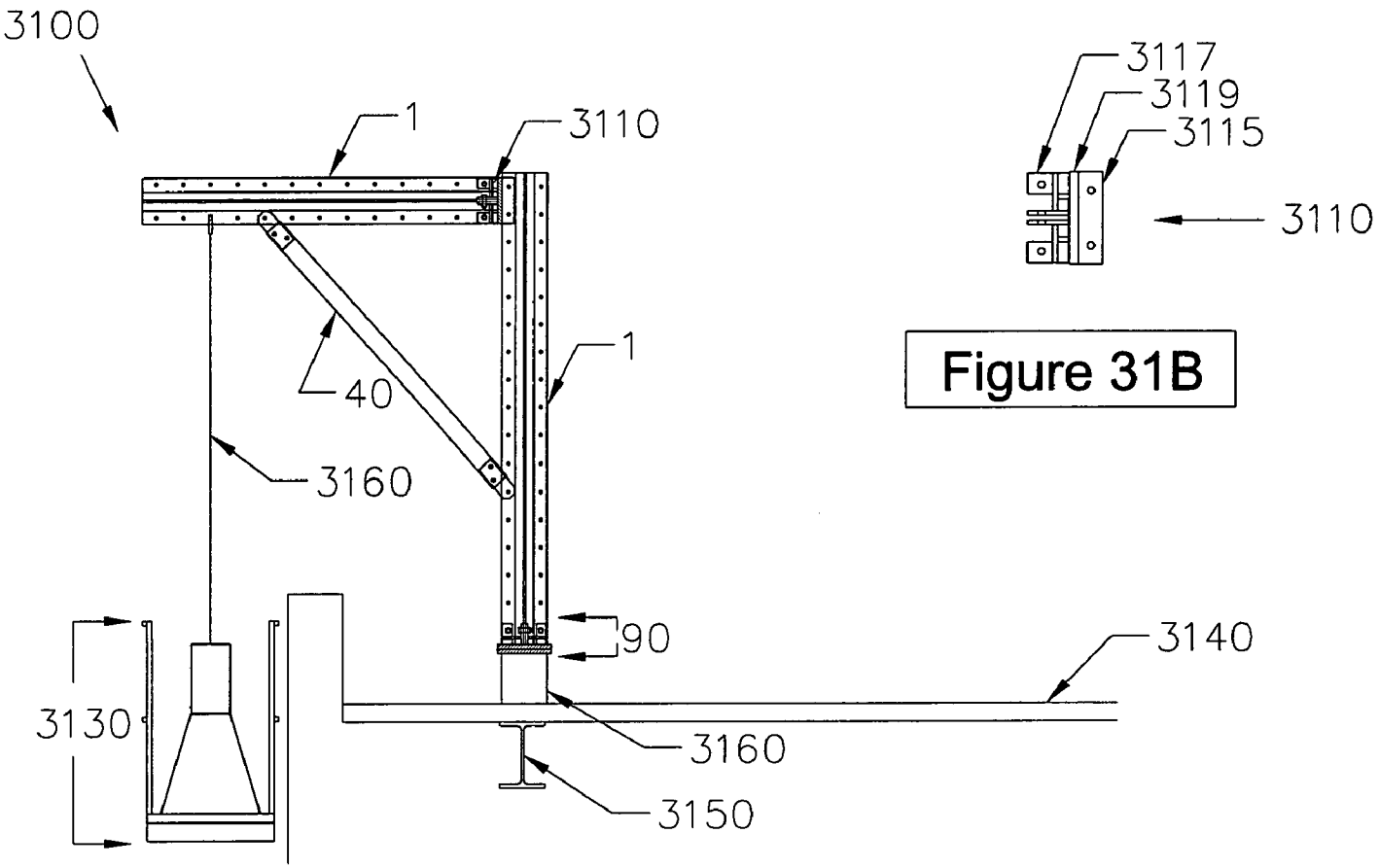
FIG. 31A is a partial cross-sectional view of a first embodiment of a support structure for a hung rig utilizing the subject structural member.
FIG. 31B is an example connection member for connecting one structural member at a right angle to another structural member, according to the invention.

FIGS. 31A, 31B, 32, and 33 illustrate example arrangements and components for constructing a so-called "hung rig" utilizing the subject structural member 1. Typically, window-washing and maintenance platforms are suspended over the side of buildings using arms mounted to the building. In the embodiment of FIG. 31A, a davit post 3160, which is typically included in a building, supports a the rig 3100, which is attached thereto by means of an end cap 90. The end cap 90 may be bolted thereto, or may be configured to include a sleeve that slips over the davit post 3160 to find support. In this embodiment, a vertical structural member 1 is attached to a horizontally-configures structural member 1, and is braced by bracing member 40. The work platform 3130 is suspended therefrom by cables 3160. FIG. 31B illustrates an example connection element 3110 for the purposes of attaching the horizontal and vertical structural members to each other at a right angle. The connection element 3130 has on one side, a portion 3117 similar to end cap 90 for secure attachment to one structural member 1, while on the other, it has a portion 3115 similar to splice member 60 for attachment to the flange 3 of the other structural member 1. In-between these portions 3115 and 3117, is a junction 3119 that may be a simple weld, a bolted adapter, or other suitable connection. Though shown in the embodiment of FIG. 31A with the flange portion 3115 attached to the vertical structural member, and the portion 3117 secured to the horizontal structural member 1, this arrangement may be reversed, with the horizontal structural member 1 laying atop the vertical structural member 1, connected thereto by the connection element 3110.

Figure 32:
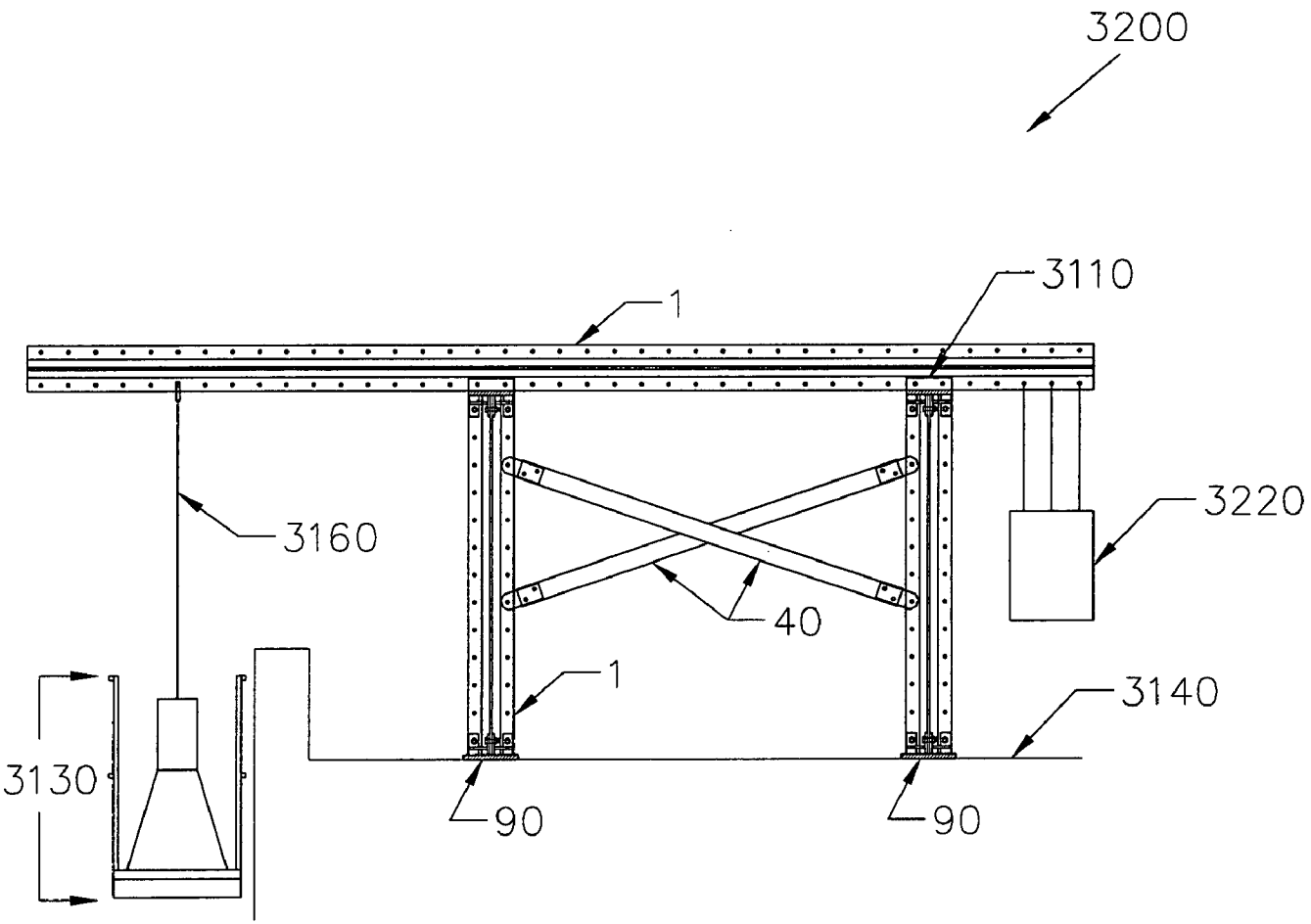
FIG. 32 is a side view of a second embodiment of a support structure for a hung rig utilizing the subject structural member.

FIG. 32 illustrates an alternate embodiment of a hung rig 3200. In this embodiment, a horizontal structural member 1 is affixed atop two vertical structural members 1, with the work platform 3130 suspended off a first end, and an optional counterweight 3220 attached at the other. This embodiment 3200, is, of course, of a higher capacity than that of FIG. 31. In this embodiment, the end caps 90 are attached at roof level. Such an arrangement is possible with the above and below-described hung rigs 3100, 3300. Also, bracing members 40 are applied between vertical structural members 1.

Figure 33:
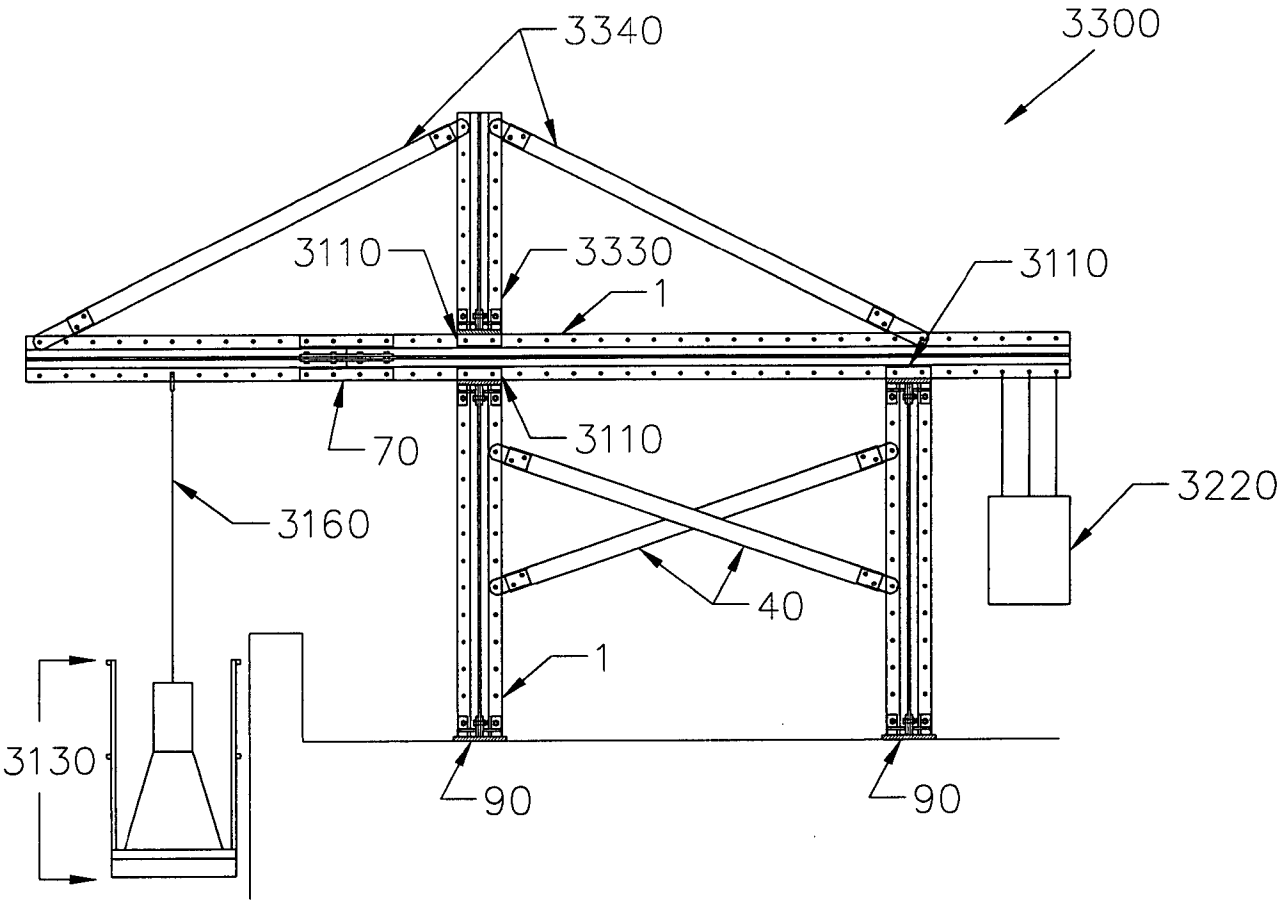
FIG. 33 is a side view of a third embodiment of a support structure for a hung rig utilizing the subject structural member.

FIG. 33 illustrates an additional alternate embodiment for a hung rig 3300, according to the present invention. The overall structure is most similar to that of FIG. 32, but in this embodiment has an additional vertical tower segment 3330 constructed from the structural member 1, which acts as an intermediate support for cable-stays 3340, that support the extended portion of the rig 3300. and help balance the load in combination with the counterweight 3220. In this embodiment, though not necessarily employed, the cantilevered section comprises a splice 70, joining portions of the structural member used therefor. As with the rig 3200, this rig 3300 includes bracing members 40. Also, in this embodiment, the work platform 3130 is suspended by a plurality of cables 3160.

Figure 34:
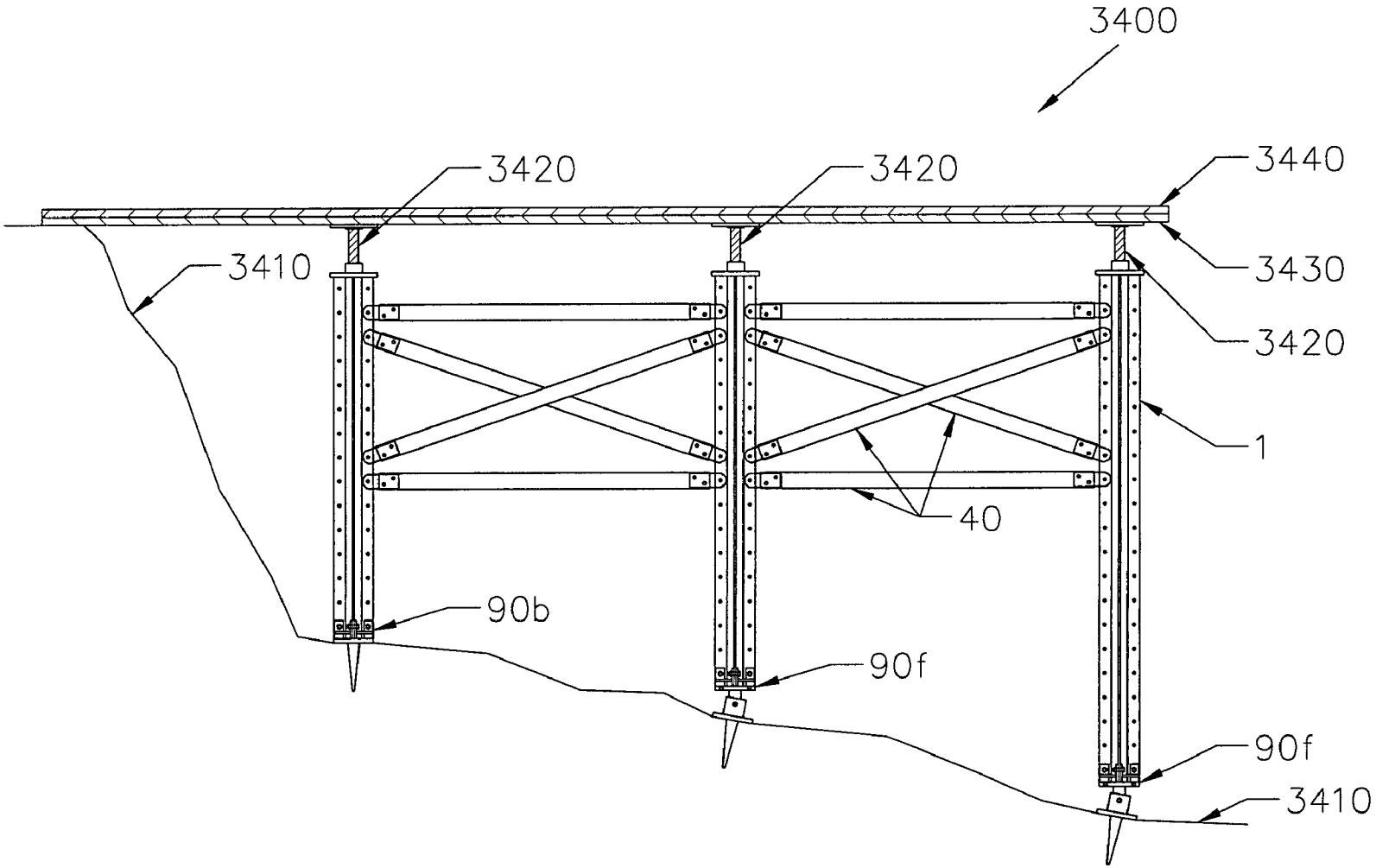
FIG. 34 is a side view of a platform constructed utilizing components of the subject structural systems.

FIG. 34 illustrates a platform structure according to the invention. Structural members 1 are mounted on the ground 3410, which may or may not be even, via spiked end cap 90*b* and pivotable end cap 90*f*. The structural members 1 are braced to one another by bracing members 40. To enable leveling of the attachment points, screw jacks 3420, or the like, are provided at the top of the structural members. Alternatively, they may be provided at the bottom of the structural members 1 or integral with the end caps 90*b*, 90*f*. Various layers of structure and flooring may be applied to the leveled supports (as shown, on screw jacks 3420) to build a stable platform with minimal disruption to the surrounding environment.

Figure 35B:
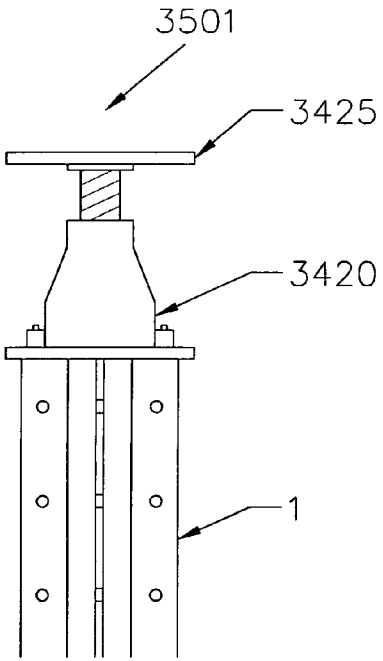
FIGS. 35A and 35B are views of example whole and partial post-shore jacks, respectively, utilizing the subject structural member.
Figure 35A:
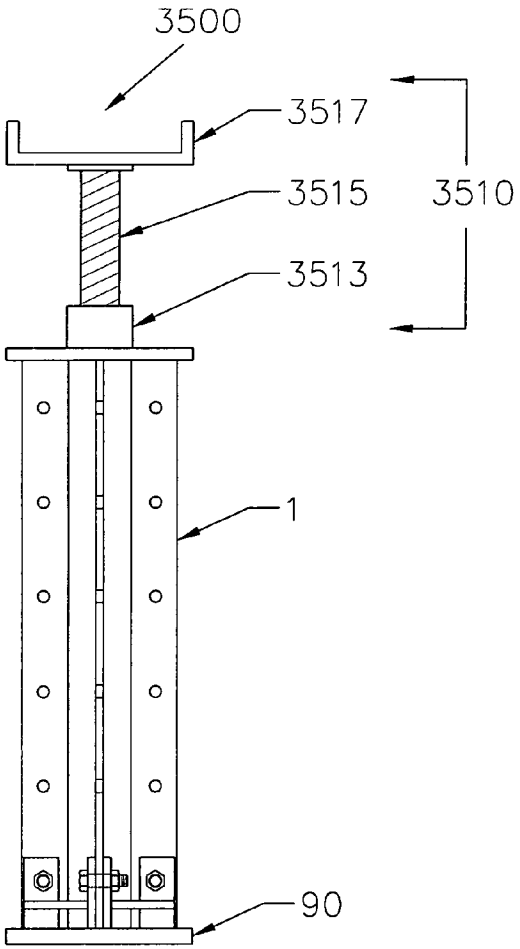

FIGS. 35A and 35B illustrate example post-shore jacks 3500, 3501 according to the present invention. With post-shore jack 2500, the screw 3515 either mates with a special collar 3513, or simply with internal threads of the structural member 1. Support plate 3517, mounted atop a pivot 3516, directly contacts and supports an external structure. When retracted, the screw of screw jack 3510 is held entirely within the inner tubular portion 2 of the structural member 1 portion of the post-shore jack 3500.

As an alternative, shown in FIG. 35B, a standard screw jack 3420 may be fitted atop (or below) a structural member 1. The screw jack 3420 may be mounted to a plate welded to the structural member 1, or may be attached via an end cap 90. Either post-shore jack 3500, 3501 can be supported on its lower end via an end cap 90.

Figure 36:
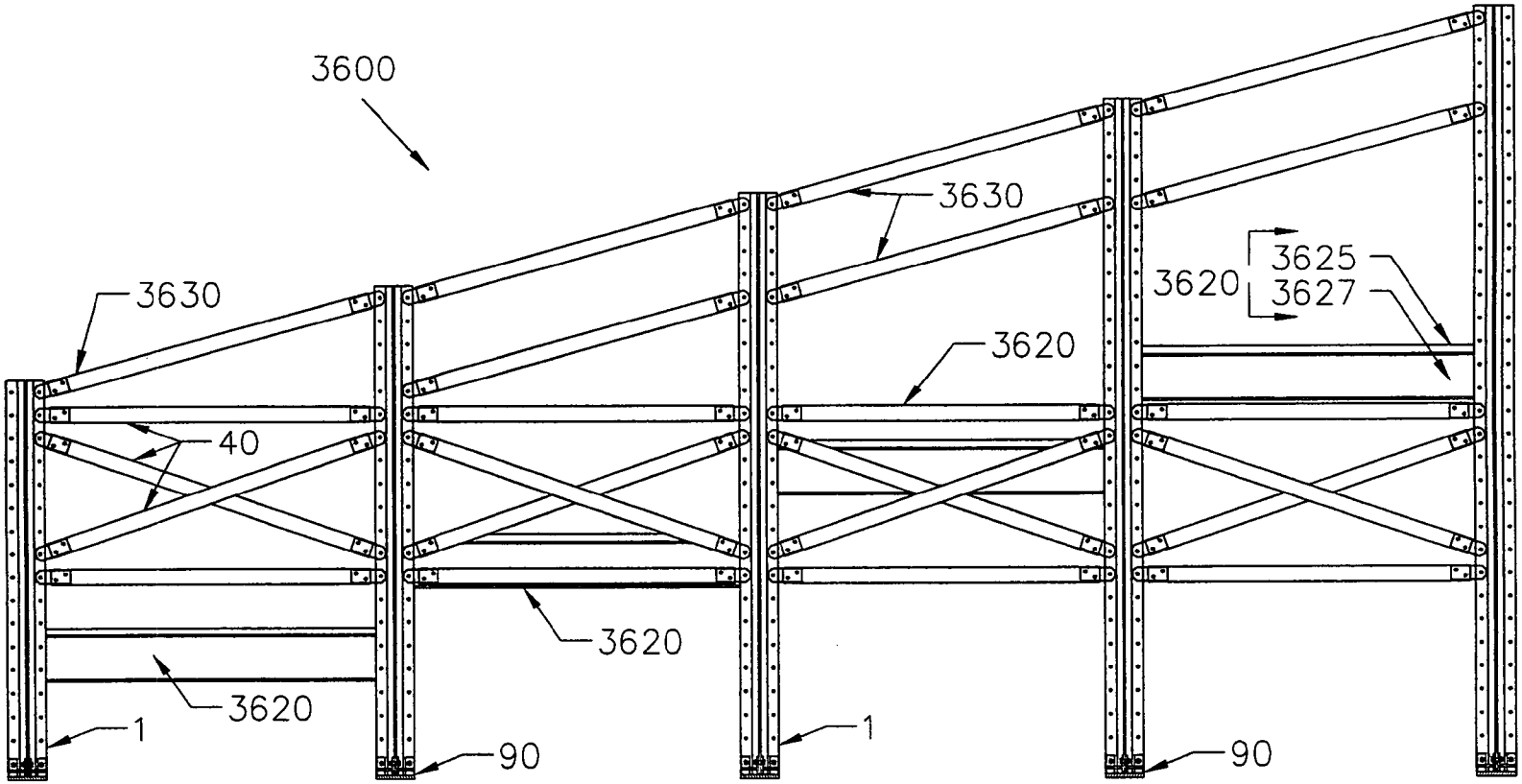
FIG. 36 is a side view of an example bleacher structure utilizing the subject structural member.

FIG. 36 illustrates the subject structural member 1 used for construction of a bleacher stand 3600. The structural member 1 is used as the primary vertical structural element, and may also be used as a horizontal element, attached, for example, with connection element 3110. Floor platform sections 3620 may be supported by horizontal beams, 3627, for example, I-beams, but may alternatively also be structural member 1, and include a decking material 3625, which may be any conventional decking material, such as pre-fabricated metal decking panels. The vertical structural members 1 are braced to one another by braces 40, and a hand railing 3630 is applied along the top of the structural members 1. A particular benefit to using the subject structural member 1, is that regularly spaced holes 4, along the length of the structural members 1 provide versatile attachment points for bracing, platforms and the like.

Similarly, the structural member 1 may be used as leg for high-capacity shelving units. As with the bleachers, horizontal members can be bolted to the structural member 1 to support shelves, or the shelves themselves can be directly bolted to the structural member 1.

Figure 37:
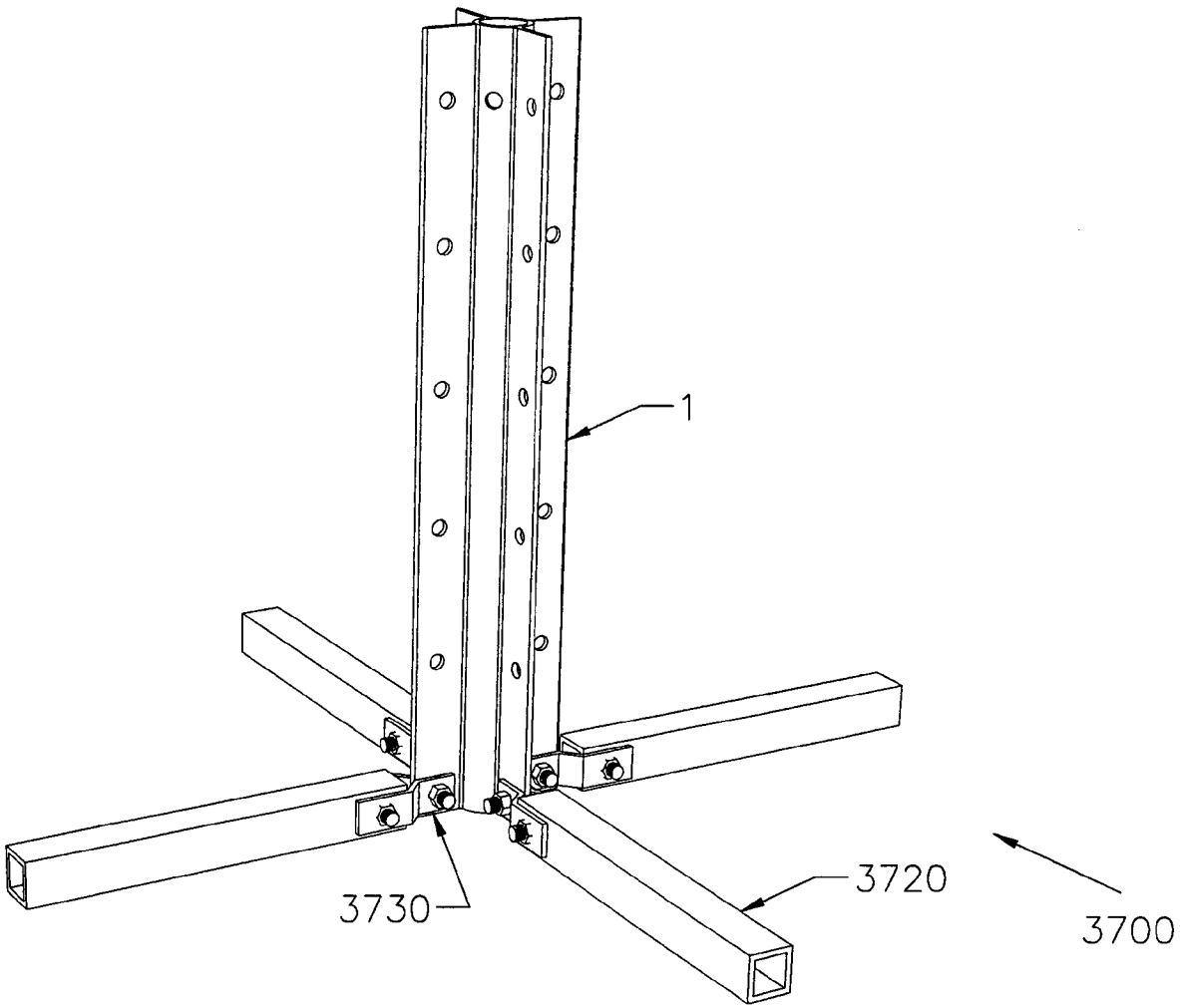
FIG. 37 is an isometric view of an example temporary sign support utilizing the subject structural member.

FIG. 37 illustrates an example temporary sign post, typically for application along roadway construction zones. In this embodiment, the structural member 1 constitutes the post, while feet 3720 prevent the post from falling over. the feet 3720 are attached to the structural member by way of connectors 3730, which may be of any conventional variety applicable. They may be rigid, or may have built into them a resiliency to allow an attached sign to sway, but not fall over.

Figure 38:
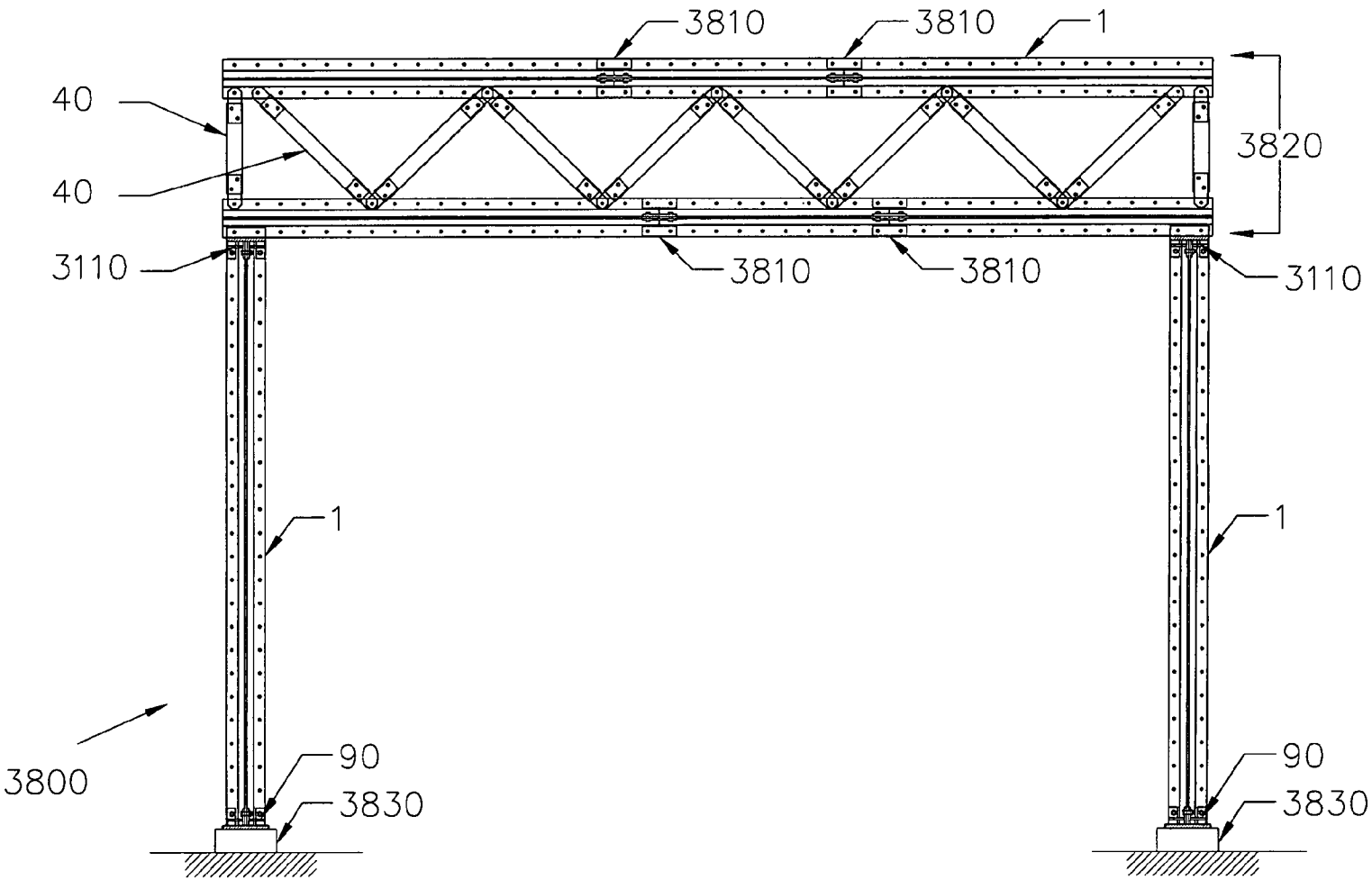
FIG. 38 is a front view of a first example embodiment of a permanent sign support structure utilizing the subject structural member.
Figure 40:
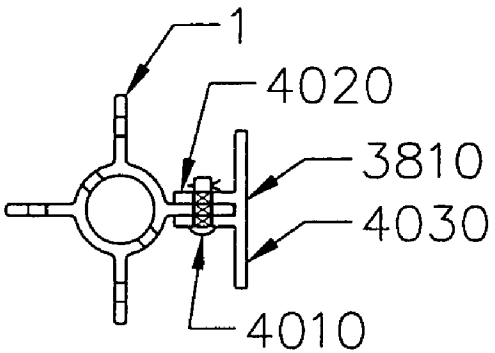
FIG. 40 is a side view of an example attachment plate for attaching objects to the subject structural member.
Figure 39:
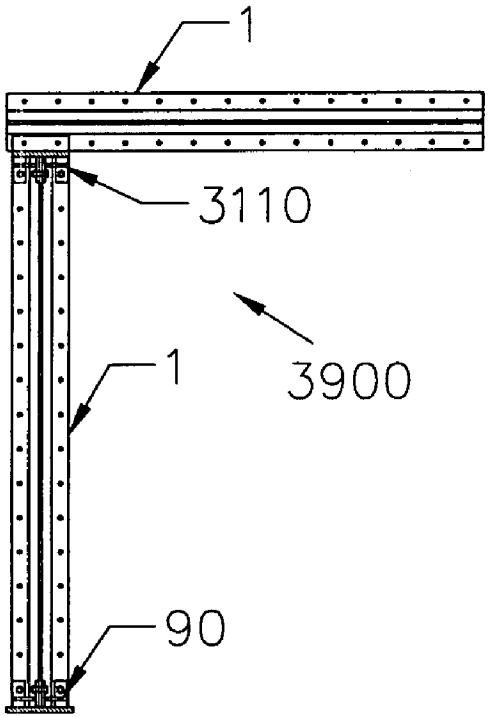
FIG. 39 is a front view of a second example embodiment of a permanent sign support structure utilizing the subject structural member.

FIGS. 38 and 39 illustrate example permanent sign support structures utilizing the structural member 1 of the present invention. Sign support 3800 incorporates the structural member 1 as vertical supports and a truss assembly 3820 to span a roadway or other feature. In this embodiment, the truss assembly 3820 is attached by connection elements 3110, and the vertical structural members 1 are mounted to footings 3830 by end caps 90, or other elements. The truss assembly may be any of the above-described types of another type, as long as it is sufficiently strong to support the loads applied to it. Sign attachment brackets 3810 are illustrated in detail in FIG. 40, and include a flange-mounting portion 4020, and a sign attachment portion 4030. The sign attachment bracket 3810 may be attached to any structural member 1 by a pin 4010 or bolt. The sign attachment portion 4030 of the sign attachment bracket 3810 may include holes for bolted attachment of signs, only a flat surface for use of adhesives, or alternatively, for attachment of a high-strength fastener, such as a some hook-and-loop fasteners.

Though simple, the cantilevered sign support structure 3900 of FIG. 39 can provide a quick, strong, versatile and inexpensive sign support structure. As shown, the vertical structural member is supported via the end cap 90, and the horizontal structural member 1 is attached to the vertical structural member 3110 by way of a connection adapter 3110, though use of any suitable connection is also possible.

Figure 41A:
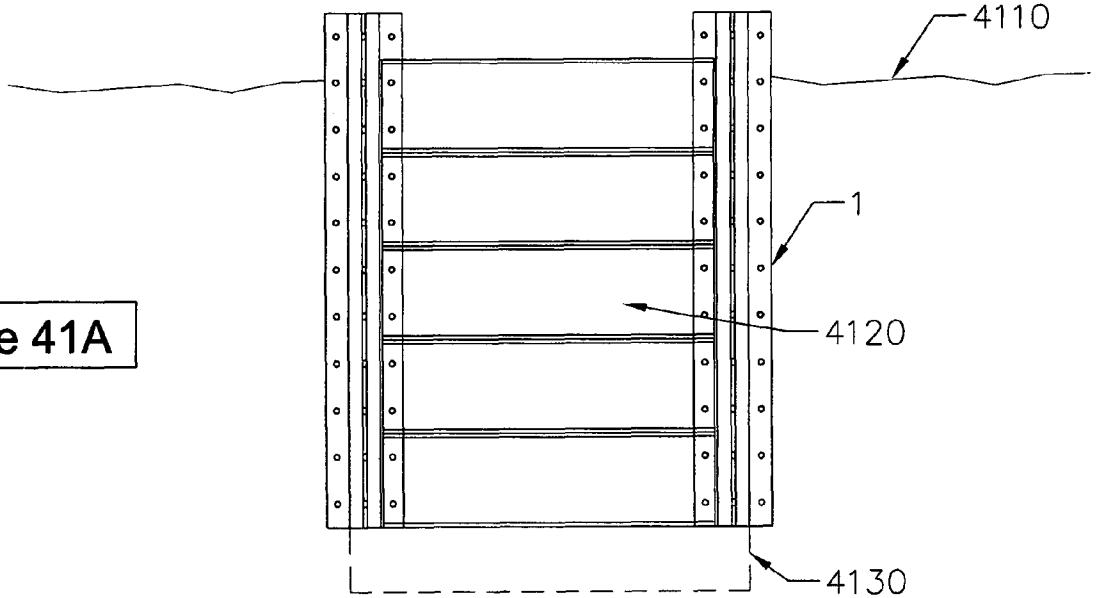
FIGS. 41A and 41B are partial cross-sectional side and top views, respectively, for an example progressive sheet-shoring structure utilizing the subject structural member.
Figure 41B:
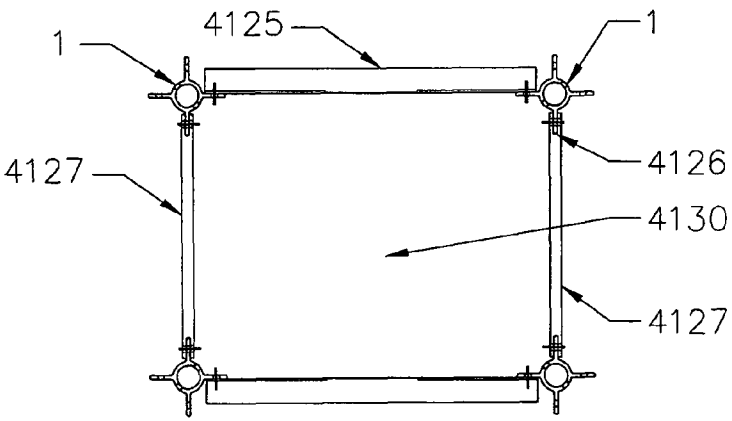

FIGS. 41A and 41B are partial cross-sectional side and top views, respectively, for an example progressive sheet-shoring structure utilizing the subject structural member 1. When digging a hole, it is often necessary to support the surrounding earth to prevent a cave-in. Accordingly, on deeper holes, in conjunction with excavation below ground level 4110, shoring walls 4125, 4127 are installed. As a hole 4130 is dug deeper, more wall panels 4120 are added below. The relatively simple and rigid connections that are possible with the structural member 1, make it particularly advantageous to use the structural member 1 for this purpose. The wall panels may include a groove 4126 on each end that slides on the flanges 3 of the structural members 1, or may be simple planks that attach by bolting or simply rest behind the structural members 1.

It is to be understood that other applications for and combinations of the subject structural member 1 are possible, and that though not specifically set forth in this document, that the spirit of the invention may be practiced in other ways.

I claim:

1. An elongated scaffolding member for use in high-rigidity structures, said elongated scaffolding member comprising an elongated hollow cylinder, a cross-section of the elongated cylinder having an uninterrupted circular inner contour and a circular outer contour interrupted by four equally-spaced radially-projecting flanges integrally joined to the elongated cylinder of the elongated scaffolding member, at the outer contour of the elongated cylinder, at 90 degree intervals about the circumference of the elongated cylinder, the elongated scaffolding member being capable of joining end-to-end to a second elongated scaffolding member, one above the other, by means of one or more structural end joint members, wherein the elongated cylinder has a length and a diameter, wherein said length is significantly longer than said diameter, and wherein the flanges extend the entirety of said length.

2. The elongated scaffolding member of claim 1 wherein the flanges have a plurality of holes that are regularly spaced along the axial length of the flanges for attaching structural members to form a scaffolding structure.

3. The elongated scaffolding member of claim 1, wherein the circular inner contour has a diameter of approximately 3 to 6 inches.

4. The elongated scaffolding member of claim 1, wherein the flanges extend radially from an outer diameter of the circular outer contour approximately 2 to 4 inches.

5. The elongated scaffolding member of claim 1, wherein the elongated cylinder and flanges have thicknesses of 0.3-0.8 inches.

6. The elongated scaffolding member of claim 1, wherein the elongated scaffolding member is manufactured by extrusion.

7. The elongated scaffolding member of claim 1, wherein the elongated scaffolding member and flanges are manufactured as an integral unit by extrusion.

8. An elongated scaffolding member for use in high-rigidity structures, said elongated scaffolding member comprising:

an elongated tubular main body with circular cross-section, the elongated tubular main body having an uninterrupted circular inner contour and a circular outer contour interrupted by four equally-spaced radially-projecting flanges, the flanges being integrally joined to the outer contour of the elongated tubular main body at 90 degree intervals about the circumference of the elongated tubular main body, the elongated scaffolding member being capable of joining end-to-end to a second elongated scaffolding member, by means of one or more structural end joint members, wherein the elongated tubular main body has a length and a diameter, wherein said length is significantly longer than said diameter, and wherein the flanges extend the entirety of said length.

9. The elongated scaffolding member of claim 8, wherein the structural end joint member comprises a joining member capable of being arranged within the inner contour of one end of the elongated scaffolding member.

10. The elongated scaffolding member of claim 8, wherein the structural end joint member comprises a joining member capable of being arranged on the exterior of the elongated scaffolding member.

11. A truss or column assembly comprising:

a plurality of elongated scaffolding members, each having an elongated tubular main body with circular cross-section, the elongated tubular main body having an uninterrupted circular inner contour and a circular outer contour interrupted by four equally-spaced radially-projecting flanges, the flanges being integrally joined to the outer contour of the elongated tubular main body at 90 degree intervals about the circumference of the elongated tubular main body; and a plurality of splice members connecting adjacent elongated scaffolding members by attaching the flanges of adjacent elongated scaffolding members to one another, wherein the elongated tubular main body has a length and a diameter, wherein said length is significantly longer than said diameter, and wherein the flanges extend the entirety of said length.

12. A truss or column assembly comprising:

a plurality of elongated scaffolding members, each having an elongated tubular main body with circular cross-section, the elongated tubular main body having an uninterrupted circular inner contour and a circular outer contour interrupted by four equally-spaced radially-projecting flanges, the flanges being integrally joined to the outer contour of the elongated tubular main body at 90 degree intervals about the circumference of the elongated tubular main body; and a plurality of bracing members connecting adjacent elongated scaffolding members by attaching the flanges of adjacent elongated scaffolding members to one another, wherein the elongated tubular main body has a length and a diameter, wherein said length is significantly longer than said diameter, and wherein the flanges extend the entirety of said length.

* * * * *